US007393088B2

(12) United States Patent
Sasaki

(10) Patent No.: US 7,393,088 B2
(45) Date of Patent: Jul. 1, 2008

(54) METHOD OF FILLING INK CARTRIDGE, CARTRIDGE FILLER, JIG, AND INK SUPPLY SYSTEM

(75) Inventor: Toyonori Sasaki, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 289 days.

(21) Appl. No.: 11/150,293

(22) Filed: Jun. 13, 2005

(65) Prior Publication Data

US 2005/0275699 A1 Dec. 15, 2005

(30) Foreign Application Priority Data

Jun. 14, 2004 (JP) ..... 2004-175111

(51) Int. Cl.
*B41J 2/17* (2006.01)
*B41J 2/175* (2006.01)

(52) U.S. Cl. ..... 347/84; 347/85

(58) Field of Classification Search ..... 347/84, 347/85, 86

See application file for complete search history.

(56) References Cited

U.S. PATENT DOCUMENTS

| | | | | |
|---|---|---|---|---|
| 5,790,157 | A | 8/1998 | Higuma et al. | |
| 6,257,711 | B1 | 7/2001 | Higuma et al. | |
| 6,257,713 | B1 * | 7/2001 | Ahn | 347/86 |
| 6,332,481 | B1 | 12/2001 | Shinada et al. | |
| 6,539,985 | B2 | 4/2003 | Shinada et al. | |
| 6,702,433 | B2 | 3/2004 | Kono | |
| 6,786,581 | B1 | 9/2004 | Shinada et al. | |
| 2001/0020970 | A1 | 9/2001 | Kuribayashi et al. | |
| 2001/0020971 | A1 * | 9/2001 | Usui et al. | 347/86 |
| 2001/0050113 | A1 | 12/2001 | Shinada et al. | |
| 2002/0024570 | A1 * | 2/2002 | Childers et al. | 347/85 |
| 2002/0060725 | A1 | 5/2002 | Shinada et al. | |

(Continued)

FOREIGN PATENT DOCUMENTS

CN 1261029 A 7/2000

(Continued)

OTHER PUBLICATIONS

Notification of First Office Action dated May 18, 2007 in Chinese Application No. 200510078124.2 and English translation thereof.

*Primary Examiner*—Stephen D. Meier
*Assistant Examiner*—Carlos A Martinez, Jr.
(74) *Attorney, Agent, or Firm*—Banner & Witcoff, Ltd.

(57) ABSTRACT

A method of filling an ink cartridge which has (i) an ink supplying portion, (ii) an air introducing portion, (ii) a first valve member disposed in the ink supplying portion and biased in a biased direction that causes the first valve member to be placed in its closed position, and (iv) a second valve member disposed in the air introducing portion and biased in a biased direction that causes the second valve member to be placed in its closed position. The method including: (a) moving each of the first and second valve members in the opposite direction away from the closed position; and (b) supplying the ink into the ink cartridge through one of the air introducing portion and the ink supplying portion, while discharging the air out of the ink cartridge through the other of the air introducing portion and the ink supplying portion. Also disclosed are a cartridge filler, a jig and an ink supply system.

22 Claims, 11 Drawing Sheets

U.S. PATENT DOCUMENTS

| | | | | |
|---|---|---|---|---|
| 2003/0160843 | A1 | 8/2003 | Hermes et al. | |
| 2004/0001126 | A1* | 1/2004 | Oda et al. | 347/85 |
| 2004/0017447 | A1* | 1/2004 | Suzuki et al. | 347/86 |
| 2004/0061748 | A1* | 4/2004 | Kuwabara et al. | 347/85 |
| 2004/0233260 | A1 | 11/2004 | Shinada et al. | |
| 2005/0024453 | A1* | 2/2005 | Steinmetz et al. | 347/86 |
| 2006/0028515 | A1* | 2/2006 | Hermes et al. | 347/85 |

FOREIGN PATENT DOCUMENTS

| | | | |
|---|---|---|---|
| CN | 1108238 | C | 5/2003 |
| CN | 1470383 | | 1/2004 |
| EP | 1000753 | A1 | 5/2000 |
| EP | 1 384 589 | A1 | 1/2004 |
| EP | 1 403 067 | A1 | 3/2004 |
| JP | 7060984 | | 3/1995 |
| JP | 2001113723 | | 4/2001 |
| JP | 3314811 | | 6/2002 |
| WO | WO 2004/028817 | A | 4/2004 |

* cited by examiner (a)

(b)

FIG.9A
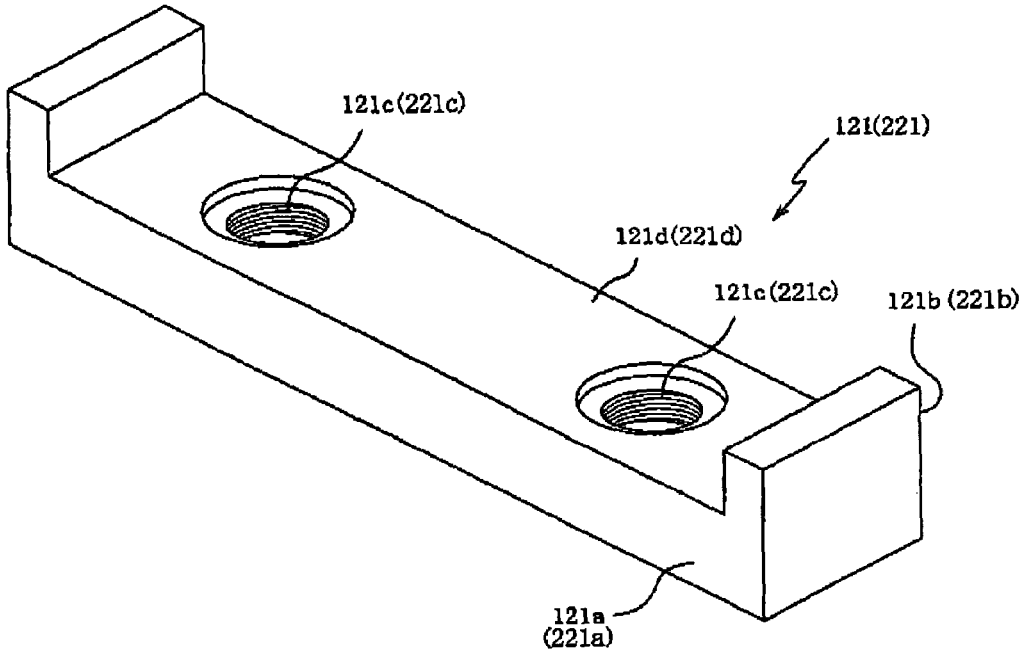
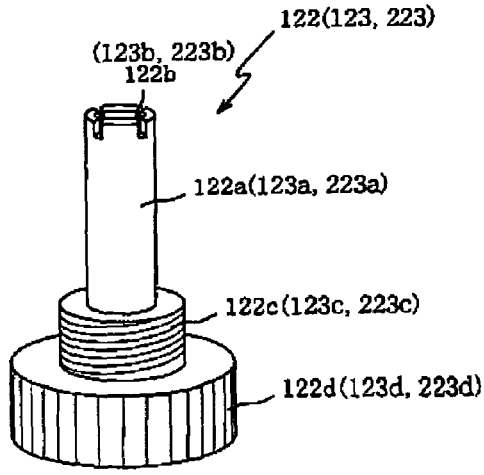
FIG.9B

METHOD OF FILLING INK CARTRIDGE, CARTRIDGE FILLER, JIG, AND INK SUPPLY SYSTEM

This application is based on Japanese Patent Application No. 2004-175111 filed on Jun. 14, 2004, the content of which is incorporated hereinto by reference.

BACKGROUND OF THE INVENTION

1. Field of the Invention

The present invention relates to a method of filling an ink cartridge, a cartridge filler, a jig used for filling the ink cartridge, and an ink supply system.

2. Discussion of Related Art

There is known an ink cartridge, as disclosed in U.S. Pat. No. 6,786,581 (corresponding to JP-2001-113723A), which is to be installed on an inkjet recording apparatus, so that an ink contained in the cartridge is consumed in a recording operation performed by the recording apparatus.

It is common that, when the ink contained in the ink cartridge is used up, the cartridge is replaced with a newly bought one, and is then discarded. However, the discard of the ink cartridge leads to an environmental contamination and a waste of limited earth resources. In this respect, there is a demand for recycle of the ink cartridge. As a method of refilling the ink cartridge, U.S. Pat. No. 6,257,711 (corresponding to JP-H07-60984A) teaches forming a through-hole in a casing body of the ink cartridge, for example, by using a drill, so that the ink cartridge can be refilled with an ink supplied through the formed through-hole. However, in this method, there is a risk that an ink delivery passage defined in a head of a recording apparatus could be clogged with debris or chips which were produced in the formation of the through-hole and then entered inside of the casing body of the ink cartridge. Further, it is difficult to completely seal the through-hole after refilling of the ink cartridge, causing an ink leakage and even disabling a normal ejection of the ink from the recording head.

Further, in the above-described method in which there is not provided a hole for allowing discharge of an air out of the ink cartridge, the presence of the air inside of the cartridge impedes an efficient refilling of the cartridge, thereby requiring a large length of time to complete the refilling of the cartridge.

SUMMARY OF THE INVENTION

The present invention was made in view of the background prior art discussed above. It is therefore a first object of the invention to provide a method of filling or refilling an ink cartridge. It is a second object of the invention to provide a cartridge filler for filling an ink cartridge. It is a third object of the invention to provide a jig used for filling an ink cartridge. It is a fourth object of the invention to provide an ink supply system for supplying an ink to a recording apparatus.

The first object may be achieved by a first aspect of the invention, which provides a method of filling an ink cartridge which has (i) an ink supplying portion provided to face an inner space of the ink cartridge so as to allow supply of an ink from the inner space therethrough, (ii) an air introducing portion provided to face the inner space so as to allow introduction of an air into the inner space therethrough, (ii) a first valve member which is disposed in the ink supplying portion and which is biased in a biased direction that causes the first valve member to be placed in a closed position thereof inhibiting the supply of the ink from the inner space through the ink supplying portion, and (iv) a second valve member which is disposed in the air introducing portion and which is biased in a biased direction that causes the second valve member to be placed in a closed position thereof inhibiting the introduction of the air into the inner space through the air introducing portion, wherein each of the first and second valve members is moved, upon installation of the ink cartridge on a recording apparatus, in an opposite direction opposite to the biased direction. The method includes: (a) a valve-member moving step of moving each of the first and second valve members in the opposite direction away from the closed position thereof, and (b) an ink supplying step of supplying the ink to the inner space of the ink cartridge through one of the air introducing portion and the ink supplying portion, while discharging the air from the inner space of the ink cartridge through the other of the air introducing portion and the ink supplying portion.

In the present method, each of the first and second valve members is moved in the opposite direction away from the closed position, and then the ink is supplied to the inner space of the ink cartridge through one of the air introducing portion and the ink supplying portion while the air is discharged from the inner space of the ink cartridge through the other of the air introducing portion and the ink supplying portion. This arrangement enables the ink cartridge to be efficiently and rapidly filled with the ink, owing to a smooth discharge of the air out of the inner space of the ink cartridge through the above-described other of the air introducing portion and the in supplying portion. Further, this arrangement is free from a problem experienced in the above-described conventional method in which a through-hole is formed in a casing body of the ink cartridge, for example, by using a drill. That is, in this method, the ink cartridge can be filed rapidly and easily, without a risk of clogging of an ink delivery passage with impurities such as debris and chips.

The second object may be achieved by a second aspect of the invention, which provides a cartridge filler for filling an ink cartridge which has (i) an ink supplying portion provided to face an inner space of the ink cartridge so as to allow supply of an ink from the inner space therethrough, (i) an air introducing portion provided to face the inner space so as to allow introduction of an air into the inner space therethrough, (iii) a first valve member which is disposed in the ink supplying portion and which is biased in a biased direction that causes the first valve member to be placed in a closed position thereof inhibiting the supply of the ink from the inner space through the ink supplying portion, and (iv) a second valve member which is disposed in the air introducing portion and which is biased in a biased direction that causes the second valve member to be placed in a closed position thereof inhibiting the introduction of the air into the inner space through the air introducing portion, wherein each of the first and second valve members is moved, upon installation of the ink cartridge on a recording apparatus, in an opposite direction opposite to the biased direction. The cartridge filler includes: an ink supplier operable to move one of the first and second valve members in the opposite direction away from the closed position thereof, and to supply the ink to the inner space of the ink cartridge, through one of the air introducing portion and the ink supplying portion in which the one of the first and second valve members is disposed; and an air discharger operable to move the other of the first and second valve members in the opposite direction away from the closed position thereof, and to discharge the air from the inner space of the ink cartridge, through the other of the air introducing portion and the ink supplying portion in which the other of the first and second valve members is disposed.

The present cartridge filler is provided with: the ink supplier operable to move one of the first and second valve members in the opposite direction away from its closed position, and to supply the ink to the inner space of the ink cartridge through one of the air introducing portion and the ink supplying portion in which the above-described one of the first and second valve members is disposed; and the air discharger operable to move the other of the first and second valve members in the opposite direction away from its closed position, and to discharge the air from the inner space of the ink cartridge through the other of the air introducing portion and the ink supplying portion in which the above-described other of the first and second valve members is disposed. Owing to the provision of the ink supplier and the air discharger, the two valve members can be placed in their open positions with an easy operation, and the ink can be supplied to the inner space of the ink cartridge through the above-described one of the air introducing portion and the ink supplying portion, while the air can be discharged from the inner space of the ink cartridge through the above-described other of the air introducing portion and the ink supplying portion. Thus, the ink cartridge can be efficiently and rapidly filled with the ink.

The third object may be achieved by a third aspect of the invention, which provides a jig used for filling an ink cartridge which has (i) an ink supplying portion provided to face an inner space of the ink cartridge so as to allow supply of an ink from the inner space therethrough, (ii) an air introducing portion provided to face the inner space 80 as to allow introduction of an air into the inner space therethrough, (iii) a first valve member which is disposed in the ink supplying portion and which is biased in a biased direction that causes the first valve member to be placed in a closed position thereof inhibiting the supply of the ink from the inner space through the ink supplying portion, and (iv) a second valve member which is disposed in the air introducing portion and which is biased in a biased direction that causes the second valve member to be placed in a closed position thereof inhibiting the introduction of the air into the inner space through the air introducing portion, wherein each of the first and second valve members is moved, upon installation of the ink cartridge on a recording apparatus, in an opposite direction opposite to the biased direction. The jig includes: a first valve-lifter operable to move one of the first and second valve members in the opposite direction away from the closed position thereof; and a second valve-lifter operable to move the other of the first and second valve members in the opposite direction away from the closed position thereof. The first valve-lifter includes a first communication-passage establisher operable, when the one of the first and second valve members is moved away from the closed position thereof by the first valve-lifter, to establish a first communication passage in one of the air introducing portion and the ink supplying portion in which the one of the first and second valve members is disposed, such that the first communication passage allows supply of the ink to the inner space of the ink cartridge through the one of the air introducing portion and the ink supplying portion. The second valve-lifter includes a second communication-passage establisher operable, when the other of the first and second valve members is moved away from the closed position thereof by the second valve-lifter, to establish a second communication passage in the other of the air introducing portion and the ink supplying portion in which the other of the first and second valve members is disposed, such that the second communication passage allows discharge of the air from the inner space of the ink cartridge through the other of the air introducing portion and the ink supplying portion.

The present jig is provided with: the first valve-lifter operable to move one of the first and second valve members in the opposite direction away from the closed position thereof and the second valve-lifter operable to move the other of the first and second valve members in the opposite direction away from the closed position thereof. The first valve-lifter serves also as the first communication-passage establisher for establishing the first communication passage which allows supply of the ink to the inner space of the ink cartridge through the above-described one of the air introducing portion and the ink supplying portion. The second valve-lifter serves also as the second communication-passage establisher for establishing the second communication passage which allows discharge of the air from the inner space of the ink cartridge through the above-described other of the air introducing portion and the ink supplying portion. Thus, when each of the first and second valve-lifters is operated to move to a corresponding one of the first and second valve members toward its open position, each of the first and second communication passages is established by a corresponding one of the first and second valve-lifters. This arrangement facilitates an operation of filling the ink cartridge with the ink.

The fourth object may be achieved by a fourth aspect of the invention, which provides an ink supply system for supplying an ink to a recording apparatus. The system includes: (I) an ink cartridge which has (i) an ink supplying portion provided to face an inner space of the ink cartridge so as to allow supply of an ink from the inner space therethrough, (ii) an air introducing portion provided to face the inner space so as to allow introduction of an air into the inner space therethrough, (iii) a first valve member which is disposed in the ink supplying portion and which is biased in a biased direction that causes the first valve member to be placed in a closed position thereof inhibiting the supply of the ink from the inner space through the ink supplying portion, and (iv) a second valve member which is disposed in the air introducing portion and which is biased in a biased direction that causes the second valve member to be placed in a closed position thereof inhibiting the introduction of the air into the inner space through the air introducing portion, wherein each of the first and second valve members is moved, upon installation of the ink cartridge on a recording apparatus, in an opposite direction opposite to the biased direction; and (II) the cartridge filler defined in the second aspect of the invention.

In the present ink supply system, owing to the provision of the ink supplier and the air discharger in the cartridge filler, the two valve members of the ink cartridge can be easily placed in their open positions substantially concurrently with each other, and then the supply of the ink to the inner space of the ink cartridge and the discharge of the air from the inner space of the cartridge can be made substantially concurrently with each other. Thus, the ink cartridge can be efficiently and rapidly filled with the ink.

BRIEF DESCRIPTION OF THE DRAWINGS

The above and other objects, features, advantages and technical and industrial significance of the present invention will be better understood by reading the following detailed description of presently preferred embodiment of the invention, when considered in connection with the accompanying drawings, in which:

FIG. 9A is a perspective view showing an attachment body of a jig which constitutes the cartridge filler of FIG. 8;

FIG. 9B is a perspective view showing a valve lifter that is to be attached to the attachment body of FIG. 9A;

DETAILED DESCRIPTION OF THE PREFERRED EMBODIMENT

Figure 1:
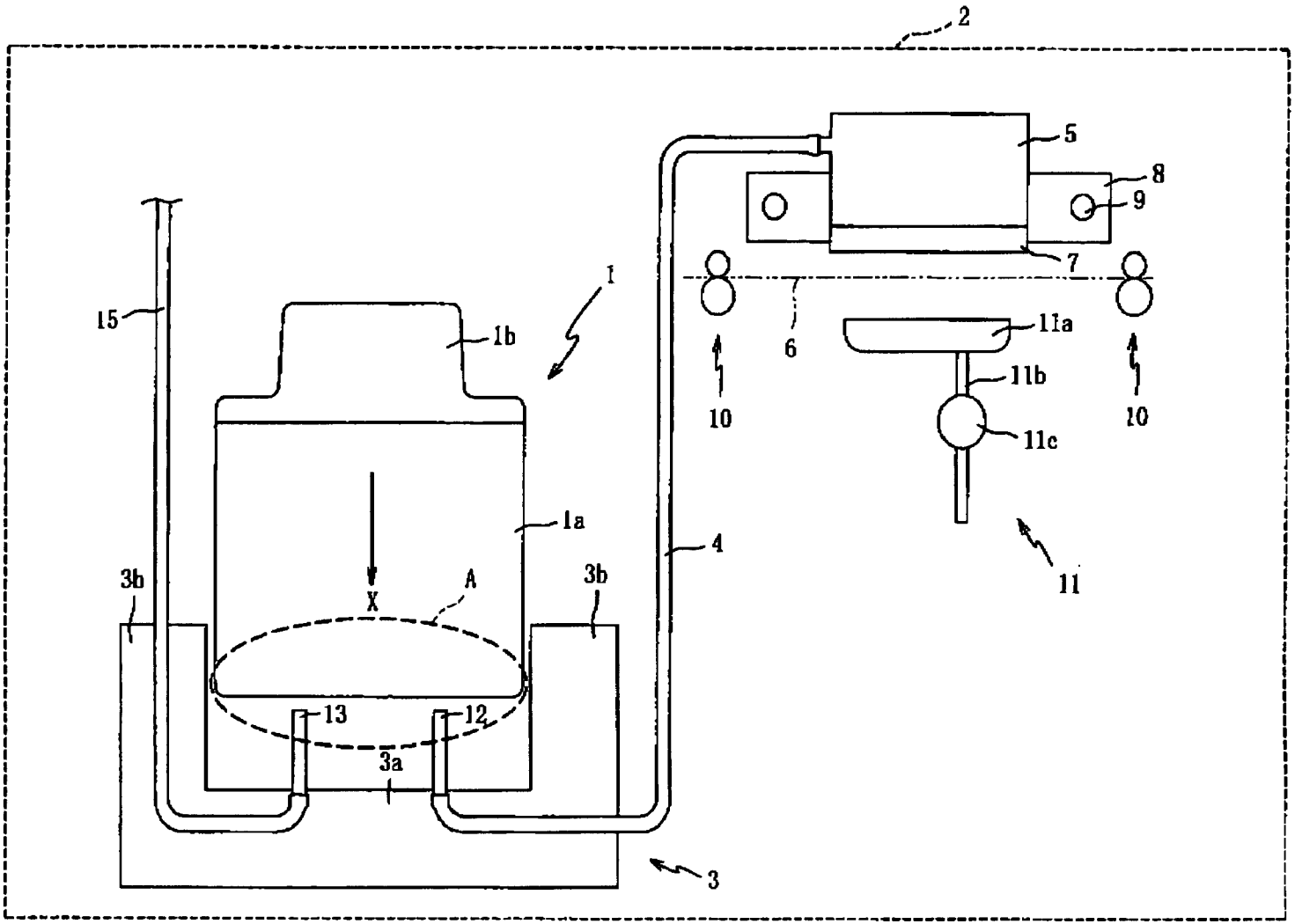
FIG. 1 is a view schematically showing an inkjet recording apparatus equipped with an ink cartridge.

Referring first to the perspective view of FIG. 1, there is shown an inkjet recording apparatus in the form of an inkjet printer 2 equipped with a plurality of ink cartridges 1 and a recording head 7 from which an ink is to be ejected toward a paper sheet 6 as a recording medium. Each of the ink cartridge 1 is a storage for storing the ink that is to be supplied to the recording head 7, and is removably installed on the inkjet printer 2.

Each of the ink cartridges 1 has a casing body 1*a* which is provided by a hollow box having an upper opening. The casing body 1*a* is fluid-tightly closed at its upper opening by a lid 1*b*, and defines an inner space serving as an ink chamber 16 (see FIG. 2) for storing the ink that is to be supplied to the recording head 7. It is noted that the plurality of ink cartridges 1 store respective four color inks (e.g., cyan, magenta, yellow and black inks) for enabling the inkjet printer 2 to perform a full-color printing operation.

The inkjet printer 2 includes: a mount portion 3 on which each of the ink cartridges 1 is removably mounted; a buffer tank 5 for storing the ink supplied from the corresponding ink cartridge 1 through an ink supplying tube 4; the recording head 7 for ejecting the ink stored in the buffer tanks 5, toward the paper sheet 6; a carriage 8 for carrying the buffer tank 5 and the recording head 7; a pair of guide shafts 9 for guiding the carriage 8 which is horizontally movable along a straight line; a feeding device 10 for feeding the paper sheet 6 in a predetermined direction; and a purging device 11.

Each mount portion 3 has a base portion 3*a* and a pair of guide portions 3*b* which extend from respective opposite end portions of the base portion 3*a*. An ink supplying pipe 12 and an air introducing pipe 13 are provided to project from the base portion 3*a*, so that the ink stored in the ink cartridge 1 can be supplied to an exterior of the ink cartridge 1 through the ink supplying pipe 12 while an atmospheric air can be introduced into the ink cartridge 1 through the air introducing pipe 13. Each of the pipes 12, 13 has a cutout 81 (see FIG. 2) formed in its upper end portion, so that the cutout 81 serves as a communication passage, which maintains a communication between inside and outside of the pipe when the pipe is held in contact with a valve member that is described below.

The ink supplying pipe 12 is connected at its lower end portion to the ink supplying tube 4, so as to be held in communication with the buffer tank 5 via the ink supplying tube 4. The air introducing pipe 13 is connected at a lower end portion to an air introducing tube 15, so as to be held in communication with an atmosphere via the air introducing tube 15.

For installing the ink cartridge 1 onto the inkjet printer 2, the cartridge 1 is moved toward the mount portion 3 in a direction indicated by arrow X (see FIG. 1) so as to be mounted onto the mount portion 3. In this instance, the ink supplying pipe 12 and the air introducing pipe 13 are brought into contact with first and second valve members 32, 82 of respective ink-supply-side and air-introduction-side valve devices 23, 24 which are built in the ink cartridge 1, and lift or move upwardly the valve members 32, 32 so as to be held in communication with the ink chamber 15 which is located on an upper side of the valve members 32, 32.

The recording head 7 has a plurality of nozzles formed through its nozzle-defining surface that is to be opposed to the paper sheet 6. In a printing operation, the ink stored in the tank 5 is ejected through the nozzles toward the paper sheet 6, with activation of a piezoelectric actuator, while the carriage 8 carrying the recording head 7 is being reciprocated.

The recording head 7 is located in a position higher than the mount portion 3, so that the ink within the nozzles is subjected to a negative pressure (back pressure) which is generated by a head difference between the ink the nozzles of the recording head 7 and the ink cartridge 1 mounted on the mount portion 3.

The purging device 11 is disposed in a purging operation position located outside a printing area (within which the recording head 7 is moved for achieving the printing operation), and is opposed to the recording head 7 when the recording head 7 is positioned in the purging operation position. The purging device 11 has a purge cap 11*a*, a waste ink tube 11*b* and a pump 11*c*. The purge cap 11*a* is provided to cover the nozzle-defining surface of the recording head 7. The pump 11*c* is activated to suck poor-quality or waste ink from the nozzles through the waste ink tube 11*b* which is held in communication with the purge cap 11*a*.

In a purging operation, the carriage 8 is moved to the purging operation position, and the nozzle-defining surface of the recording head 7 is covered with the purge cap 11*a*. The pump 11*c* is then activated to suck waste ink containing bubbles which remain in the recording head 7. The thus sucked ink is delivered through the waste ink tube 11*b* to a waste ink tank (not shown). It is noted that the printing operation and the purging operation are effected under control of CPU (central processing unit) which is incorporated in the inkjet printer 2.

Figure 2:
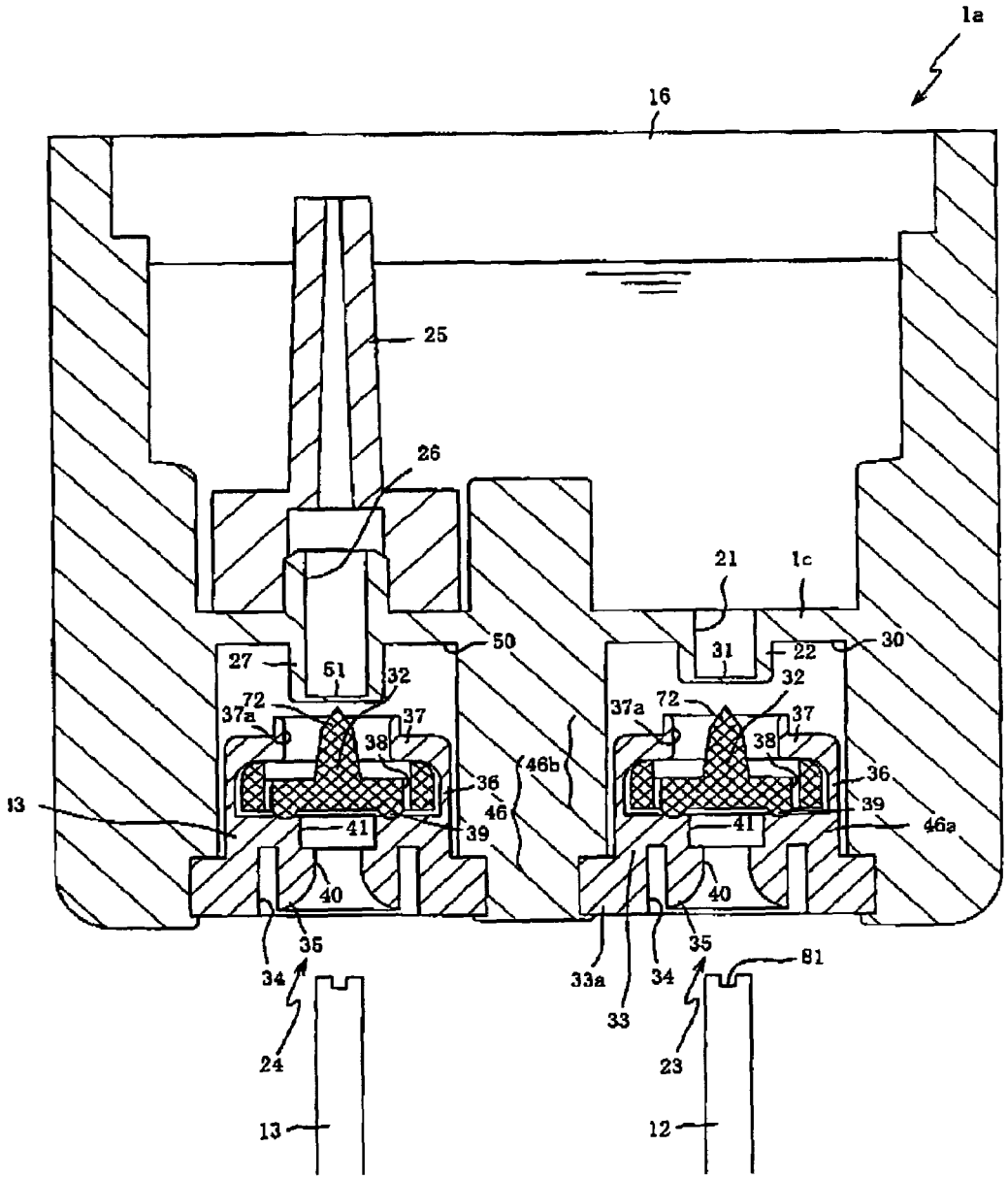
FIG. 2 is a cross sectional view showing a first-type ink cartridge.
Figure 3:
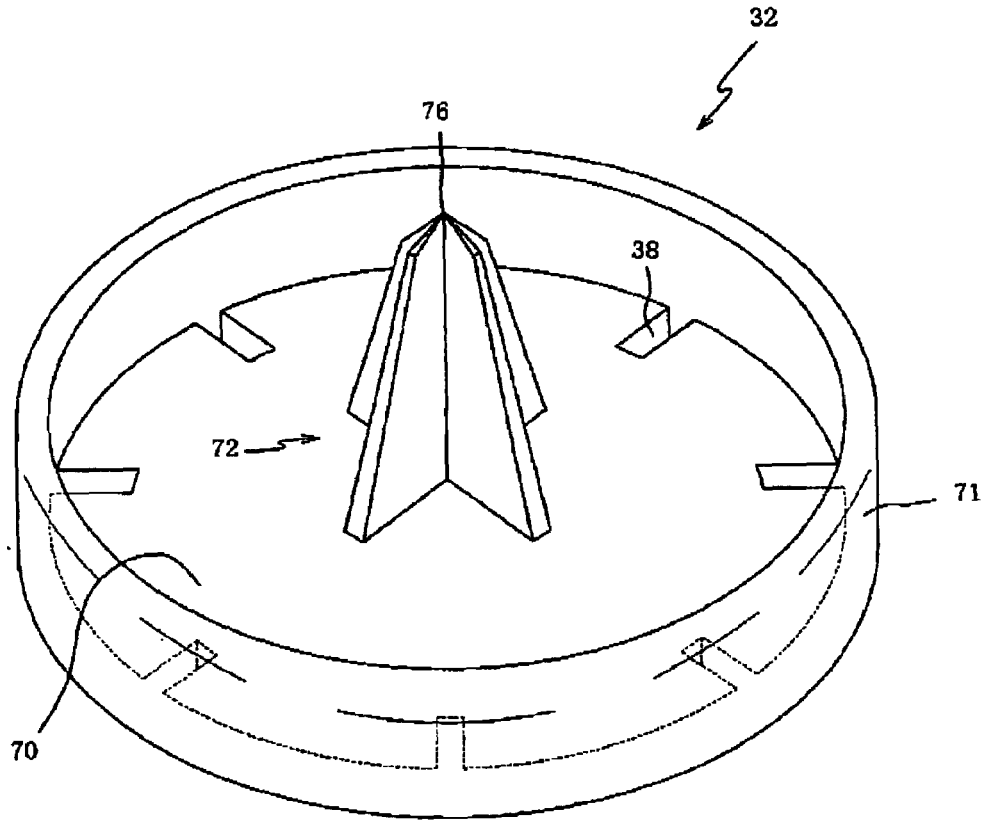
FIG. 3 is a perspective view showing a valve member of the first-type ink cartridge of FIG. 2.

Referring next to FIGS. 2 and 3, there will be described a joint portion (circled by broken line A in FIG. 1) at which the ink cartridge 1 is jointed to the inkjet printer 2. FIG. 2 is a cross sectional view of the joint portion of the ink cartridge 1 before the cartridge 1 is installed on the inkjet printer 2. FIG. 3 is a perspective view in enlargement showing the valve member 32.

The casing body 1*a* of the ink cartridge 1 has a tubular outer wall and a partition wall 1*c* which are formed integrally with each other, such that an inner space surrounded by the tubular outer wall is divided by the partition wall 1*c* into upper and lower regions. The upper region serves as the ink chamber 16, while the lower region serves as an ink supplying chamber 30 and an air introducing chamber 50. When the ink cartridge 1 is mounted on the mount portion 3, the ink supplying pipe 12 and the air introducing pipe 13 are introduced into the ink supplying chamber 30 and the air introducing chamber 50, respectively.

The partition wall 1*c* defines an upper end of the ink supplying chamber 30, and has a communication hole 21 through which the ink chamber 16 and the ink supplying chamber 30 are communicable with each other. A tubular wall 22 extends downwardly from an outer periphery of the communication hole 21, and is closed at its lower opening end by a thin wall 31 (which is formed integrally formed with the other portions of the casing body 1), so that the communication hole 21 is closed by the thin wall 31. The partition wall 1*c* defines also an upper end of the air introducing chamber 50, and has a communication hole 26 through which the ink chamber 16 and the air introducing chamber 50 are communicable with each other. A tubular wall 27 extends downwardly from an outer periphery of the communication hole 26, and is closed at its lower opening end by a thin wall 51 (which is formed integrally formed with the other portions of the casing body 1), so that the communication hole 26 is closed by the thin wall 51. This arrangement assures a sealing of the ink chamber 16 in which the ink is stored, until the thin walls 31, 51 are broken as described below. It is noted that the tubular wall 27 extends downwardly from the partition wall 1*c* by a distance larger than that by which the tubular wall 22 extends downwardly from the partition wall 1*c*, so that the thin wall 51 closing the lower opening end of the tubular wall 27 is closer to a breaker portion 72 of the valve body 32, than the thin wall 31 closing the lower opening end of the tubular wall 22.

An air guiding tubular wall 25 extends upwardly from the outer periphery of the communication hole 26, so as to protrude into the ink chamber 16. The air guiding tubular wall 25 has an upper opening end which is located above a level of the ink stored in the ink chamber 16, so that the atmospheric air introduced through the air introducing pipe 13 is delivered along a guide passage defined in the air guiding tubular wall 25 to an upper region of the ink chamber 16.

The ink-supply-side and air-introduction-side valve devices 23, 24 are fixedly received in the ink supplying chamber 30 and the air introducing chamber 50, respectively. Since the valve devices 23, 24 are identical in construction with each other, only the ink-supply-side valve device 23 will be described.

The valve device 23 is constituted by an elastically-deformable holding member 46 which is provided by a single piece made of a rubber or other elastic material, and the valve member 32 is made of a synthetic resin. The holding member 46 has a generally tubular shape, and includes a valve seat portion 46*a*, a biasing portion 46*b*, a tubular portion 35 and an outer circumferential wall portion 33. The valve seat portion 46*a* is provided by its axially intermediate portion. The biasing portion 46*b* is located on one of axially opposite sides of the valve seat portion 46*a* that is closer to the ink chamber 16 than the other of the axially opposite sides of the valve seat portion 46*a*. The tubular portion 35 is located on the other of the axially opposite sides of the valve seat portion 46*a*. The outer circumferential wall 33 surrounds the tubular portion 35, such that the outer circumferential wall 33 is radially spaced apart from the tubular portion 35 by a predetermined distance, and such that an outer circumferential surface of the tubular portion 35 and an inner circumferential surface of the outer circumferential wall 33 are circumferentially extend in parallel with each other. The valve member 32 is held in the holding member 46, while being biased by the biasing portion 46*b* in a biased direction that causes the valve member 32 to be seated on the valve seat potion 46*a* so as to be placed in its closed position.

The outer circumferential wall 33 has, in one of axially opposite end portions that is remote from the biasing portion 46*b*, a large-diameter portion 33*a* which projects outwardly in the radial direction, so that the biasing portion 46*b* and the other portion of the outer circumferential wall 33 have a diameter smaller than a diameter of the large-diameter portion 33*a*. The ink supplying chamber 30 has a small-diameter region and a large-diameter region which is located on one of axially opposite sides of the small-diameter region that is remote from the ink chamber 16. The biasing portion 46*b* of the holding member 46 is accommodated in the small-diameter region of the ink supplying chamber 30, while the large-diameter portion 33*a* of the holding member 46 is accommodated in the large-diameter region of the ink supplying chamber 30.

The valve seat portion 46*a* and the tubular portion 35 of the holding member 46 have a through-hole 41 and a pipe receiver hole 40 which are both located at an axis of the holding member 46 and which are held in communication with each other. When the ink cartridge 1 is mounted on the mount portion 3, the ink supplying pipe 12 is fluid-tightly fitted into the pipe receiver hole 40 of the tubular portion 35. In this respect, the pipe receiver hole 40 may be considered to serve as a sealer. It is noted that the pipe receiver hole 40 has, in its axially outside portion, a tapered portion whose diameter is increased as viewed in an axially outward direction of the hole 40.

The biasing portion 46*b* of the holding member 46 includes a side wall portion 36 which extends from a periphery of the valve seat portion 46*a* in a direction toward the ink chamber 16, and an upper wall portion 37 which extends from the side wall portion 36 in a radially inward direction so as to be in contact with one of axially opposite end surfaces of the valve member 32 that is remote from the valve seat portion 46*a*. The upper wall portion 37 extends radially inwardly from the side wall portion 36 over a predetermined distance, so as to define an opening 37*a* which is surrounded by the upper wall portion 37. Owing to an elasticity of the material forming the holding member 46, the biasing portion 46*b* of the holding member 46 biases the valve member 32 in the biased direction that causes the valve member 32 to be seated on the valve seat portion 46*a*. Thus, the valve member 32 is normally held in close contact with the valve seat portion 46*a*, namely, normally placed in its closed position. However, when the ink cartridge 1 is mounted on the mount portion 3, the ink supplying pipe 12 is introduced into the pipe receiver hole 40 and the through-hole 41, and then forces the valve member 32 upwardly, i.e., toward the ink chamber 16. With the valve member 32 being thus forced upwardly, the side wall portion 36 and the upper wall portion 37 of the biasing portion 46*b* of the holding member 46 are expanded and inclined, respectively, thereby allowing the valve member 32 to be moved upwardly. The upward movement of the valve member 32 causes formation of a communication passage between the valve member 32 and the valve seat portion 46*a* (see FIG. 4B).

As shown in FIG. 3, the valve member 32 includes: a bottom portion 70 which is to be in contact with the valve seat portion 46*a* of the holding member 46; an outer circumferential wall portion 71 which extends from a periphery of the bottom portion 70 in an upward direction (i.e., direction toward the ink chamber 16); and a breaker portion 72 provided by a protrusion which protrudes from substantially a center of the bottom portion 70 in the upward direction. The breaker portion 72 has a distal end 76 which is shaped to have a sharp point and which is positioned in a position higher than a distal end of the outer circumferential wall portion 71 (see FIG. 4A).

The valve member 32 has a plurality of communication holes 38 which are formed through the bottom portion 70 and which are located in a radially outer end portion of the bottom portion 70. In this embodiment, a total of eight communication holes 38 are formed to be equi-annularly spaced apart from each other. Further, the bottom portion 70 has, in its surface that is to be opposed to the valve seat portion 46*a* of the holding member 46, an annular protrusion 39 which is located on a radially inner side of the communication holes 38 and on a radially outer side of the through-hole 41 of the holding member 46 (see FIG. 2). With the valve member 32 being accommodated in the holding member 46, the circumferential wall portion 71 of the valve member 32 is held in close contact with a lower surface of the upper wall portion 37 of the biasing portion 46*b* of the holding member 46, and is forced downwardly. Since the valve member 32 is thus forced downwardly, the valve seat portion 46*a* of the holding member 46 is elastically deformed by the annular protrusion 39 which is held in close contact with the valve seat portion 46*a*.

The breaker portion 72, extending through the opening 37*a* surrounded by the upper wall portion 37 of the biasing portion 46*b*, is opposed to the above-described thin wall 31, with a predetermined spacing distance therebetween. The distant end 76 of the breaker portion 72 is given the sharp point, for easily breaking the thin wall 31.

Figure 4A:
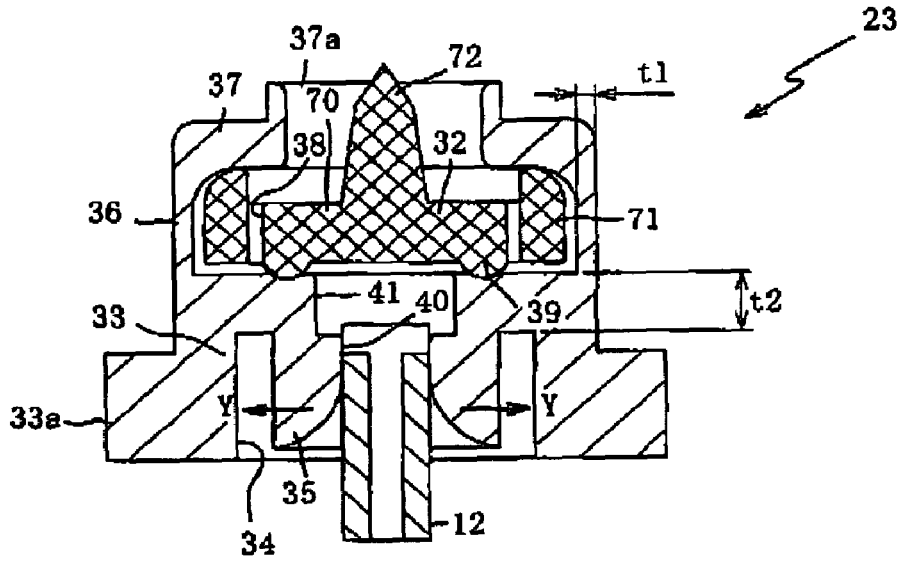
FIGS. 4A and 4B are views showing movement of the valve member of FIG. 3, wherein its closed state is illustrated in FIG. 4A while its open state is illustrated in FIG. 4B.
Figure 4B:
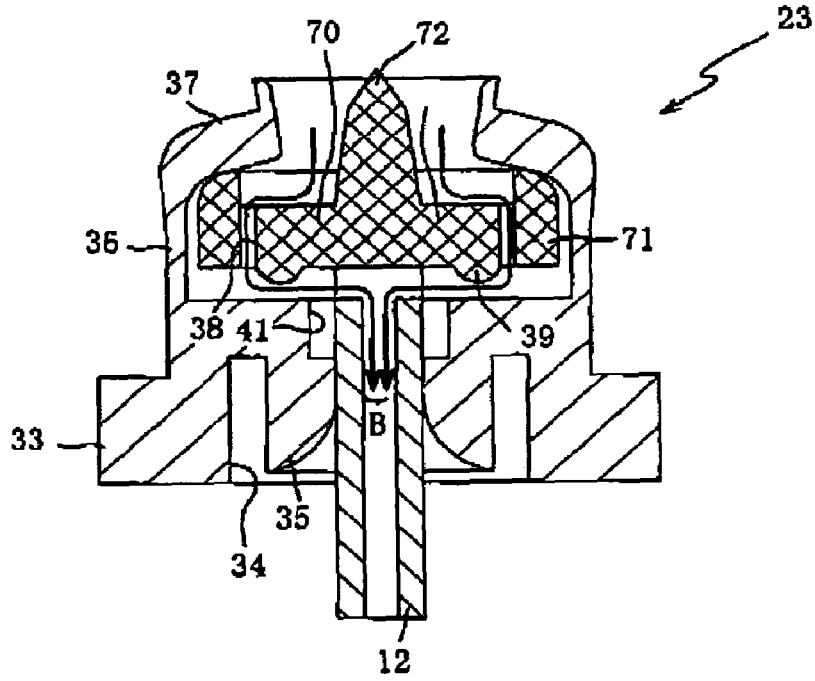

Referring next to FIGS. 4A and 4B, there will be described an operation of the ink-supply-side valve device 23 upon installation of the ink cartridge 1 on the inkjet printer 2.

When the ink cartridge 1 is mounted on the mount portion 3, the ink supplying tube 12 is introduced into the pipe receiver hole 40, and is brought into close contact with an inner circumferential surface of the pipe receiver hole 40, for thereby avoiding leakage of the ink (see FIG. 4A). When the ink supplying tube 12 is further moved in a direction toward the ink chamber 16, the tube 12 is brought into contact with the valve member 32, whereby the valve member 32 is forced in the direction toward the ink chamber 16. The valve member 32 is moved against the elasticity of the biasing portion 46*b*, so as to be separated from the valve seat portion 46*a* (see FIG. 4B). When the tube 12 is still further moved in the direction toward the ink chamber 16, the thin wall 31 is broken by the breaker portion 72 which is brought at its sharply-pointed distal end 76 with the thin wall 31. As a result of the breakage of the thin wall 31, the ink stored in the ink chamber 16 is supplied to the ink supplying chamber 30. The ink supplied to the ink supplying chamber 30 is delivered toward the recording head 7, via the opening 37*a* (i.e., an upper opening end of the valve device 23), the communication holes 38 of the valve member 32, a spacing gap between the lower surface of the valve member 32 and the upper surface of the valve seat portion 46*a*, the cutout 81 (formed in the upper end portion of the ink supplying pipe 12), and an ink delivery passage defined in the ink supplying pipe 12

While the ink supplying tube 12 is introduced into the pipe receiver hole 40, the air introducing tube 13 is introduced into the pipe receiver hole 40 of the holding member 46 of the air-introduction-side valve device 24, so as to upwardly move the valve member 32 of the valve device 24. Since the thin wall 51 closing the lower opening end of the tubular wall 27 is closer to the distal end 76 of the breaker portion 72 of the valve member 32 than the thin wall 31 closing the lower opening end of the tubular wall 21, as described above, the thin wall 51 is broken in an earlier stage than the thin wall 31.

When the ink cartridge 1 is dismounted from the mount portion 3 for removing the ink cartridge 1 from the inkjet printer 2, the ink supplying tube 12 and the air introducing tube 13 are separated from the respective valve members 32. As a result of the separation of the tubes 12, 13 from the valve members 32, each of the valve members 32 is brought back into close contact with the valve seat portion 46*a*, owing to a biasing force exerted by the biasing portion 46*b*. The ink chamber 16 is fluid-tightly dosed by the annular protrusion 39 interposed by and between the valve member 32 and the valve seat portion 46*a* which are opposed to each other, whereby an ink leakage is reliably prevented. In this instance, there might be some ink remaining in the opening 41 of the valve seat portion 46*a* of the ink-supply-side valve device 23. However, the remaining ink forms a meniscus in the opening 41 or pipe receiver hole 40, without a risk that the remaining ink comes out of the ink cartridge 1, because the valve member 32 held in its closed position avoids an atmospheric pressure from acing on the remaining ink, and because the opening 41 or pipe receiver hole 40 has a diameter as small as about 2 mm. It is noted that the above-described communication hole 21 and ink supplying chamber 80 cooperate with each other to constitute an ink supplying portion facing the ink chamber 16 as the inner space of the ink cartridge 1, and that the above-described guide passage defined in the air guiding tubular wall 25, communication hole 26 and air introducing chamber 50 cooperate with each other to constitute an air introducing portion facing the ink chamber 16.

Figure 5:
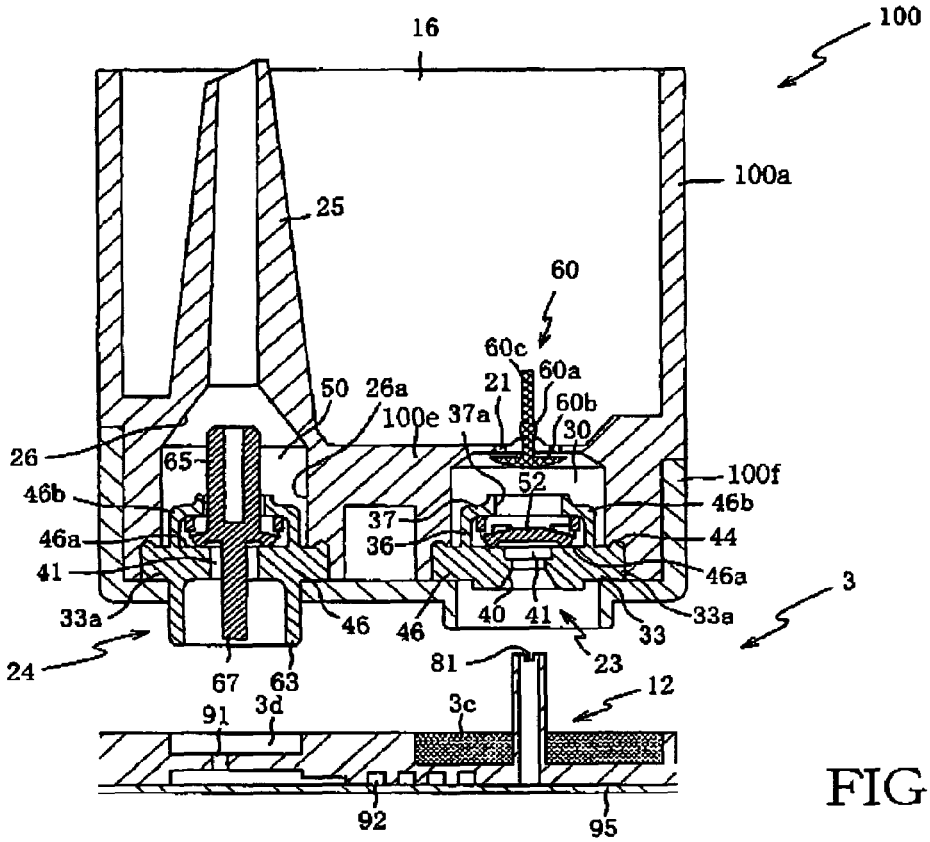
FIG. 5 is a set of views showing installation of a second-type ink cartridge on an inkjet recording apparatus, wherein the view (a) illustrates the ink cartridge before the installation while the view (b) illustrates the ink cartridge as installed on the recording apparatus.
Figure 5:
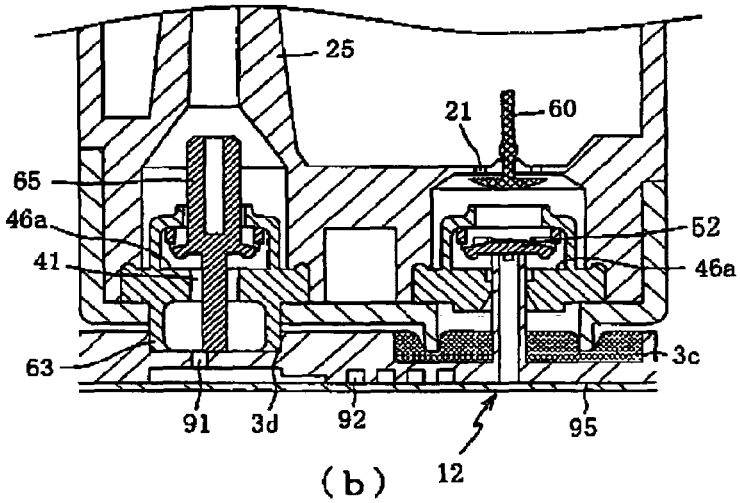

Referring next to FIG. 5, there will be described a second-type ink cartridge 100. In the following description of the second-type ink cartridge 100, the same reference numerals as used in the above description of the ink cartridge 1 as a first-type ink cartridge will be used to identify the functionally corresponding or structurally similar elements.

The mount portion 3 has the ink supplying pipe 12 through which the ink stored in the ink cartridge 100 is delivered toward the recording head 7, and an air introducing hole 91 through which the atmospheric air is supplied into the cartridge 100. The pipe 12 has the cutout 81 formed in its upper end portion, so that the cutout 81 serves as the communication passage, which maintains a communication between inside and outside of the pipe 12 when the pipe 12 is held in contact at its upper end portion with a first valve member 52. In a portion of the upper surface of the base portion 3*a* which portion surrounds a proximal end portion of the ink supplying pipe 12, there is disposed an elastic member 3*c* which is provided by a porous body such as a sponge. In the event of an ink leakage, the ink can be absorbed by this elastic member 3*a*. It is noted that the pipe 12 is connected at its lower end to the ink supplying tube 4.

A recess 3*d* is formed in another portion of the upper surface of the base portion 3*a* which portion is opposed to the air-introduction-side valve device 24. This recess 3*d* has a size that permits the recess 3*d* to be fitted onto a sealing portion 63 of the holding member 46 when the ink cartridge 100 is mounted on the mount portion 3. The above-described air introducing hole 91 is formed in a bottom of the recess 3*d*, such that the air introducing hole 91 is located inside of the sealing portion 63 and is not aligned with an axial extension 67 of a second valve member 65 (which is described below). In a lower surface of the mount portion 3, there is formed a slot 92 serving as an air delivery passage. The slot 92 is held, at one of opposite ends, in communication with an air intake (not shown).

A casing body 100*a* of the ink cartridge 100 includes a tubular outer wall and a bottom wall 100*e*, and has a hollow-box like shape as a whole. The casing body 100*a* defining the ink chamber 16 is covered at its bottom surface with a cap member 100*f*. On a lower side of the bottom wall 100*e*, there are located the ink supplying chamber 30 and the air introducing chamber 50 in which the respective valve devices 23, 24 are fixedly received.

In the second-type ink cartridge 100, the air introducing portion is constituted by the guide passage defined in the air guiding tubular wall 25, the communication hole 26 (which is tapered) and the air introducing chamber 50. The air guiding tubular wall 26 extends upwardly from the bottom wall 100*e* such that the upper opening end of the tubular wall 25 is located above the level of the ink stored in the ink chamber 16.

The plurality of communication holes 21 are formed through the bottom wall 100*e*, such that the ink chamber 16 and the ink supplying chamber 30 are communicable with each other therethrough. The communication holes 21 are selectively opened and closed by a valve member 60 which is made of a synthetic resin. The valve member 60 includes a head portion 60*b* and a stem portion 60*a* which are formed integrally with each other. The head portion 60*b* is opposed to lower ends of the respective communication holes 21, and is held by the stem portion 60*a* which is slidably received in a through-hole formed through the bottom wall 1*e*. The valve member 60 is normally held in its open position in which the head portion 60*b* is spaced apart from the communication holes 21 while an annular protrusion 60*a* provided in the stem portion 60*a* is held in contact with the upper surface of the bottom wall 100*e*, whereby the ink is allowed to flow in a direction away from the ink chamber 16 toward the valve device 23. However, when there is caused a flow of the ink in the opposite direction (i.e., a direction away from the ink supplying pipe 12 toward the ink chamber 16), the valve member 60 is placed in its closed position in which the head portion 60*b* is moved upwardly to close the communication holes 21, thereby inhibiting the flow of the ink in the opposite direction. That is, the valve member 60 serves as a check valve. In general, an ink cartridge is sealed with its inner space being decompressed, before its use. Therefore, upon installation of the cartridge on the inkjet printer, if the ink-supply-side valve device 23 is placed in its open state before placement of the air-introduction-side valve device 24 in its open state, there would be caused the flow in the above-described opposite direction. The valve member 60 serving as the check valve prevents such a flow in the opposite direction.

The ink-supply-side valve device 23 is constituted by the elastically-deformable holding member 46 which is provided by a single piece made of a rubber or other elastic material, and the first valve member 52 is made of a synthetic resin. The holding member 46 is similar in construction with the holding member 46 of the above-described ink cartridge 1. The outer circumferential wall 33, the large-diameter portion 33*a* and the valve seat portion 46*a* are arranged to be located substantially on the same plane. The cap member 100*f* cooperates with a stepped surface 44 of the bottom wall 100*e* (which defines a part of the ink supplying chamber 30) to grip the large-diameter portion 33*a* of the holding member 46, so that the valve device 23 is fixed to the casing body 1*a*. The biasing portion 46*b* of the holding member 46 includes the side wall portion 36 which extends from the periphery of the valve seat portion 46*a* toward the ink chamber 16, and the upper wall portion 37 which extends from the side wall portion 36 in the radially inward direction so as to be in contact with one of axially opposite end surfaces of the valve member 52 that is remote from the valve seat portion 46*a*. The upper wall portion 37 extends radially inwardly from the side wall portion 36 over a predetermined distance, so as to define an opening 37*a* which is surrounded by the upper wall portion 37. Owing to an elasticity of the material forming the holding member 46, the biasing portion 46*b* of the holding member 46 biases the valve member 52 in the biased direction that causes the valve member 52 to be seated on the valve seat portion 46*a*. Thus, the valve member 52 is normally held in close contact with the valve seat portion 46*a*, namely, normally placed in its closed position.

Figure 6:
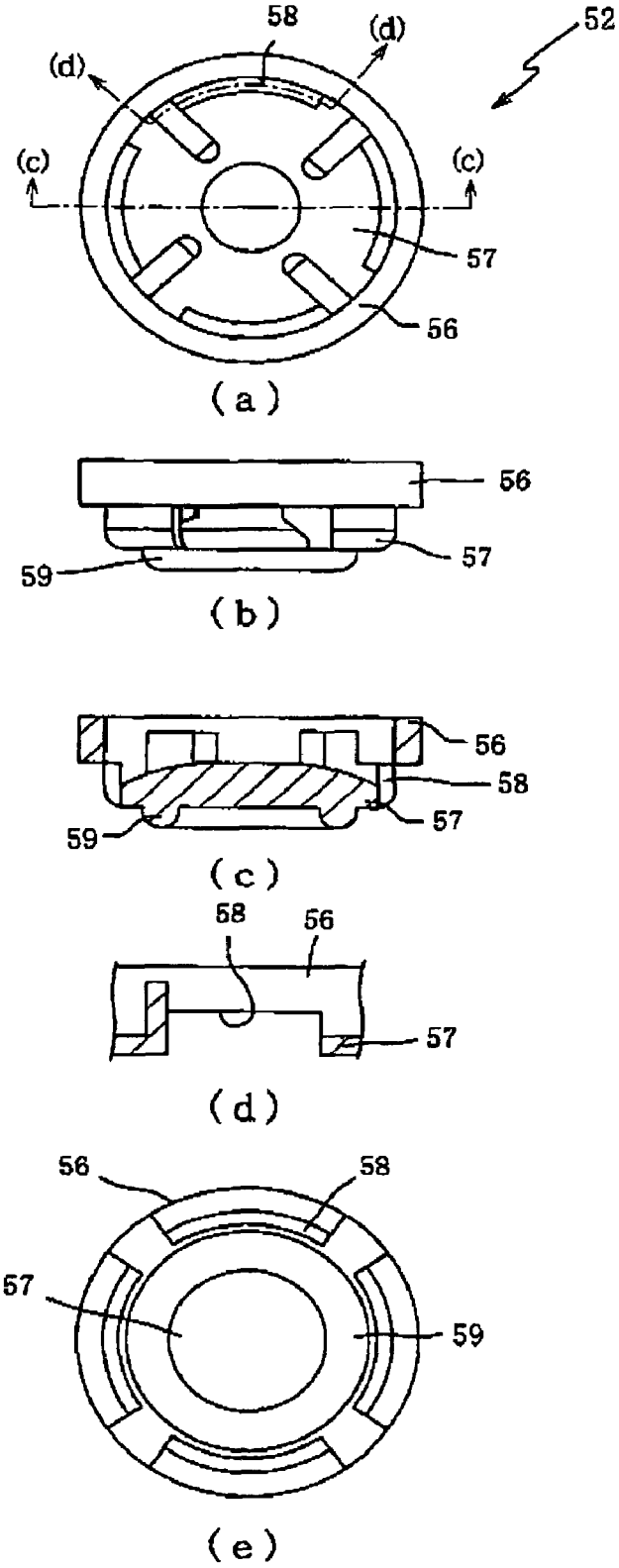
FIG. 6 is a set of views showing a first valve member of the second-type ink cartridge of FIG. 5, wherein the view (a) is an upper view, the view (b) is a side view, the view (c) is a cross sectional view taken along line (c)-(c), the view (d) is a cross sectional view taken along line (d)-(d) and the view (e) is a bottom view.

FIG. 6 is a set of views showing the first valve member 52 in detail. The valve member 52 includes a bottom portion 67 and an outer circumferential wall portion 56 which extends from a periphery of the bottom portion 57 in an upward direction. The valve member 52 has a plurality of communication apertures 58 which are formed through the bottom portion 57 and which are located in a radially outer end portion of the bottom portion 57. In this embodiment, a total of four communication apertures 58 are formed to be equiangularly spaced apart from each other. The bottom portion 57 has, in its surface that is to be opposed to the valve seat portion 46*a* of the holding member 46, an annular protrusion 59 which is located on a radially inner side of the communication apertures 58 and on a radially outer side of the through-hole 41 of the holding member 46 (see FIG. 5). The valve member 52 is held in contact at the annular protrusion 59 with the valve seat portion 46*a* of the holding member 46, when the valve member 52 is held in its closed position.

The air-introduction-side valve device 24 is constituted by the elastically-deformable holding member 46 which is provided by a single piece made of a rubber or other elastic material, and a second valve member 65 is made of a synthetic resin. Like the holding member 46 of the ink-supply-side valve device 23, the holding member 46 includes the valve seat portion 46*a*, biasing portion 46*b* and large-diameter portion 33*a* which are formed integrally with each other. Since these portions 46*a*, 46*b* and 33*a* are identical with those in the ink-supply-side valve device 23, redundant description of these portions will not be provided.

The valve seat portion 46*a* has the through-hole 41 through which the axial extension 67 of a second valve member 65 extends. The through-hole 41 is surrounded by the above-described sealing portion 63 provided by a tubular portion which is formed integrally with the valve seat portion 46*a* and which extends downwardly from the valve seat portion 46*a*.

Figure 7:
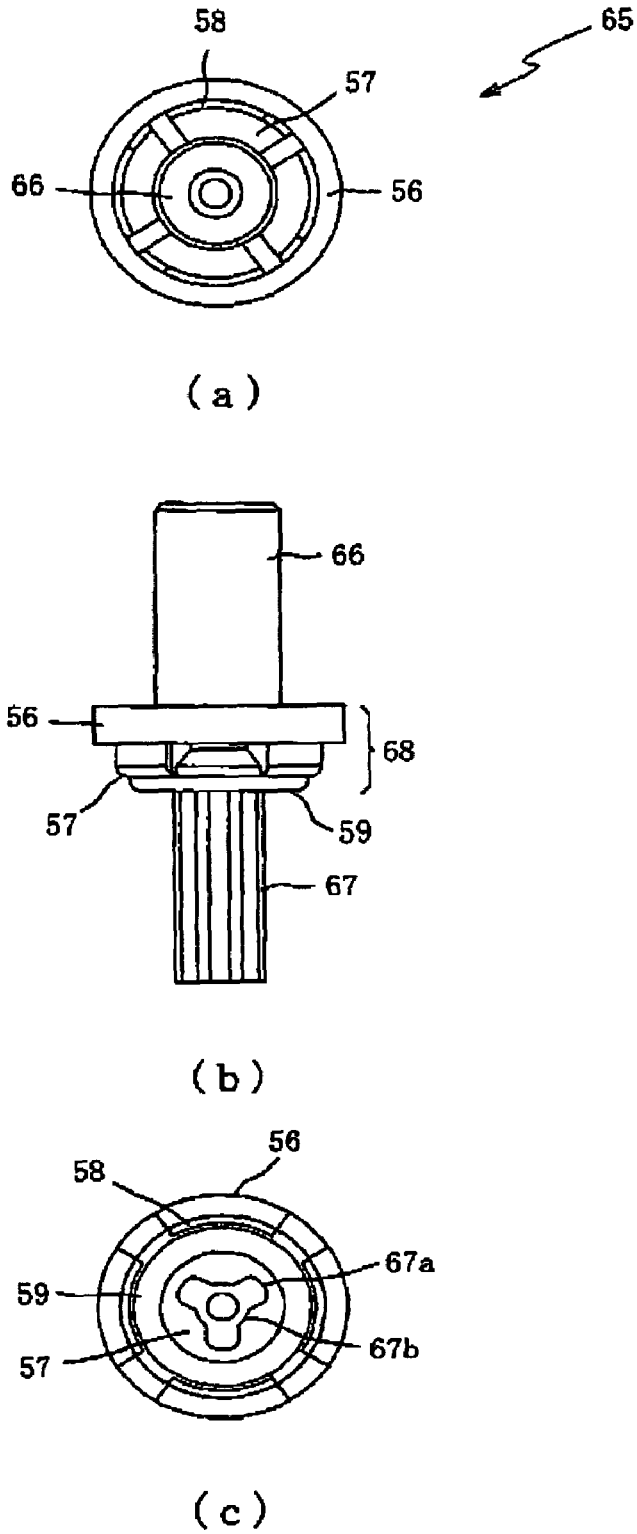
FIG. 7 is a set of views showing a second valve member of the second-type ink cartridge of FIG. 5, wherein the view (a) is an upper view, the view (b) is a side view and the view (c) is a bottom view.

FIG. 7 is a set of views showing the second valve member 65 in detail. The second valve member 65 includes a head portion 68 which is substantially identical with the entirety of the above-described first valve member 52. That is, the head portion 68 is constituted by the above-described bottom portion 57, outer circumferential wall portion 56 and communication apertures 58. The second valve member 65 further includes a cylindrical portion 66 which extends upwardly from an upper surface of the bottom portion 57. When the ink cartridge 100 is mounted on the mount portion 3 without any abnormality, the valve member 65 is lifted upward to be separated from the valve seat portion 46*a*, without the cylindrical portion 66 being brought into contact at its upper end with the tapered inner surface of the communication hole 26, namely, without inhibiting the communication between the ink chamber 16 and the through-hole 41 of the holding member 46. However, where the valve member 65 is upwardly moved, against a biasing force exerted by the biasing portion 46*b*, more than necessary, the cylindrical portion 66 is fitted at its upper end into the tapered inner surface of the communication hole 26. The cylindrical portion 66 and the tapered inner surface of the communication hole 26 are held in fitting engagement with each other, owing to a friction generated therebetween, whereby the communication between the ink chamber 16 and the air introducing chamber 50 is inhibited. That is, the second valve member 65 has a second closed position, in addition to the closed position as a first closed position (in which the valve member 65 is held in contact with the valve seat portion 46*a*), which is located on a rear side of the first closed position as viewed in the biased direction.

The second valve member 65 further has the above-described axial extension 67 which extends downwardly from a lower surface of the bottom portion 57 and which is coaxial with the cylindrical portion 66. The axial extension 67 of the second valve member 65 extends downwardly through the through-hole 41 of the holding member 46. It is noted that a plurality of axially extending recesses 67*b* are formed in an outer circumferential surface of the axial extension 67, and are equi-angularly spaced apart from each other (see the view (c) of FIG. 7).

Before the second-type ink cartridge 100 is mounted on the mount portion 3 of the inkjet printer 2, a lower end of the axial extension 67 of the second valve member 65 is positioned to be slightly higher than a lower end of the sealing portion 63 of the holding member 46. In this state before the installation of the ink cartridge 100 on the inkjet printer 2, the first valve member 52 of the ink-supply-side valve device 23 and the second valve member 65 of the air-introduction-side valve device 24 are held in close contact with the valve seat portions 46*a* of the respective holding members 46, so as to be placed in their closed positions.

When the ink cartridge 100 is mounted on the mount portion 3, the ink supplying pipe 12 is introduced into the pipe receiver hole 40 and then lifts up the first valve member 52. The lifted valve member 52 pushes and elongates the upper wall portion 37 and the side wall portion 36 of the holding member 46, respectively, and separates from the valve seat portion 46*a* of the holding member 46. The first valve member 52 is thus positioned in its open position, whereby the ink supplying chamber 30 and the ink supplying pipe 2 are brought into communication with each other though the communication apertures 58. Meanwhile, the axial extension 67 of the second valve member 65 is brought into contact at its lower end with the bottom of the recess 3*d* of the mount portion 3, whereby the second valve member 65 is pushed upwardly relative to the valve seat portion 46*a* of the holding member 46. The second valve member 65 is thus positioned in its open position, whereby the air introducing hole 91 is brought into communication with the ink chamber 16 through the air-introduction-side valve device 24. In this instance, the sealing portion 63 of the holding member 46 is brought into close contact at its lower end with the bottom of the recess 3*d*.

There will be described a method of filling the above-described first-type ink cartridge 1 and also an ink filler 120 which is used for filing the first-type ink cartridge 1.

Figure 8:
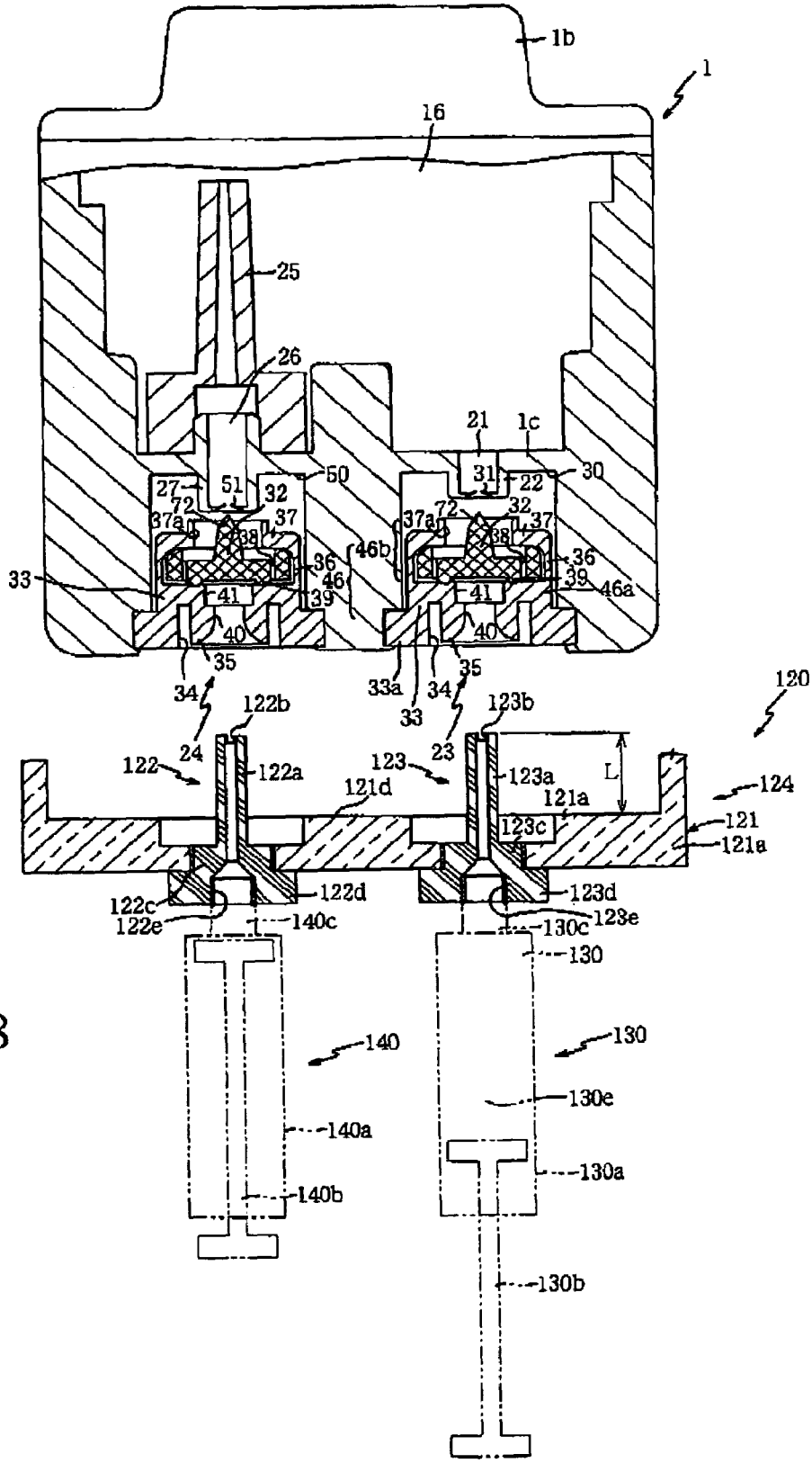
FIG. 8 is a view showing the first-type ink cartridge of the FIG. 2 and a cartridge filler for filling the first-type ink cartridge.

FIG. 8 shows a state before the ink filler 120 is attached to the ink cartridge 1. The ink filler 120 is principally constituted by a jig 124, an ink syringe 130 as an ink storage and an air sucker 140. The jig 124 includes first and second valve-lifters 123, 122 for lifting the respective first and second valve members 32, 32, and an attachment body 121 which holds the first and second valve-lifters 123, 122 so as to connect the valve lifters 123, 122 and the ink cartridge 1. As shown in FIG. 9A, the attachment body 121 has a plate-like base portion 121*a* as a contact surface definer defining a contact surface 121*d* which is to be held in contact with a lower surface of the casing body 1*a* of the cartridge 1, and opposite side wall portions 121*b* which extend upwardly from respective opposite ends of the base portion 121*a* and which is to be held in contact with respective side surfaces of the casing body 1*a* of the cartridge 1. The first and second valve-lifters 123, 122 are provided by generally cylindrical members having axial through-holes, and are held by the attachment body 121 such that a distance between axes of the respective valve-lifters 128, 122 is substantially equal to a distance between axes of the respective valve members 32 of the ink-supplying-side and air-introduction-side valve devices 23, 24. The first valve-lifter 123 cooperates with the ink syringe 130 to constitute an ink supplier, while the second valve-lifter 122 cooperates with the air sucker 140 to constitute an air discharger.

The first and second valve-lifters 123, 122 are identical in shape with each other. The valve-lifters 123, 122 include axially-elongated tubular portions 123*a*, 122*a* as contact portions, externally-threaded portions 123*c*, 122*c* and knob portions 123*d*, 122*d*, as shown in FIG. 9B. The tubular portion 123*a* of the first valve-lifter 123 is a portion that is to be introduced into the ink-supply-side valve device 23, and has substantially the same shape and dimensions as the ink supplying pipe 12. Similarly, the tubular portion 122*a* of the second valve-lifter 122 is a portion that is to be introduced into the air-introduction-side valve device 24, and has substantially the same shape and dimensions as the air introducing pipe 13. The tubular portion 123*a* has four cutouts 123*b* formed in an axially distal end portion of its tubular wall, such that the four cutouts 123*b* are equi-angularly spaced apart from each other. Similarly, the tubular portion 122*a* has four cutouts 122*b* formed in an axially distal end portion of its tubular wall, such that the four cutouts 122*b* are equi-angularly spaced apart from each other. Each of the cutouts 123*b*, 122*b* serves as a communication passage, which maintains a communication between inside and outside of the tubular wall of each of the tubular portions 123*a*, 122*a* when tubular portions 123*a*, 122*a* are held in contact with the valve members 32, 32. The first and second valve-lifters 123, 122 are detachably fixed to the attachment body 121, by screwing the externally-threaded portions 123*c*, 122*c* into internally-threaded holes 121*c*, 121*c* which are formed through the base portion 121*a* of the attachment body 121. The knob portions 123*d*, 122*d* are provided to facilitate manual rotations of the first and second valve-lifters 123, 122 for attaching or detaching them to or from the attachment body 121.

A distal end of each of the first and second valve-lifters 123, 122 attached to the attachment body 121 is distant from the contact surface 121*d* of the attachment body 121 by such a distance L (see FIG. 8) that causes, when the attachment body 121 is in contact at its contact surface 121*d* with the lower surface of the casing body 1*a* of the cartridge 1, the first and second valve-lifters 123, 122 to separate the valve members 32 from the valve seat portions 46*a* without the valve members 32 being excessively moved upwardly to be removed from the holding members 46.

The axial through-hole of each of the first and second valve-lifters 123, 122 has a large diameter portion located in its lower end portion, i.e., in one of its axially opposite end portions that is remote from the tubular portion 123*a*, 122*a*. The first valve-lifter 123 has an ink-storage fastener in the form of an internally threaded portion 123*e* which is provided in the large diameter portion of the axial through-hole, so that the ink syringe 130 as the ink storage is fastenable to the first valve-lifter 123. The second valve-lifter 122 has an air-sucker fastener in the form of an internally threaded portion 122*e* which is provided in the large diameter portion of the axial through-hole, so that the air sucker 140 is fastenable to the second valve-lifter 122.

In the present embodiment, the ink syringe 130 and the air sucker 140 are provided by respective injection syringes which are identical with each other. The ink syringe 130 and the air sucker 140 are constituted by cylindrical vessels 130*a*, 140*a* for storing liquid or gas therein, and pistons 130*b*, 140*b* slidably received in the vessels 130*a*, 140*a*. The cylindrical vessels 130*a*, 140*a* have small-diameter portions which are provided by their axial end portions. Each of the cylindrical vessels 130*a*, 140*a* has an opening 130*c*, 140*c* in its axial end in which the small diameter portion is located, so that a variable volume chamber is formed between the opening 130*c*, 140*c* and the piston 130*b*, 140*b*. An externally threaded portion is provided in at least an axially extreme end part of the small diameter portion of each of the cylindrical vessels 130*a*, 140*a*, so that the ink syringe 130 and the air sucker 140 can be fastened at their externally threaded portions to the internally threaded portions 123*e*, 122*e* of the first and second valve-lifters 123, 122, respectively, whereby the variable volume chambers of the cylindrical vessels 130*a*, 140*a* are held in communication with the axial through-holes of the first and second valve-lifters 123, 122, respectively. An ink can be stored in the variable volume chamber, i.e., in an ink storage chamber 130*e* of the ink syringe 130, by drawing the piston 130*b*, namely, by moving the piston 130*b* in such a direction that increases a volume of the ink storage chamber 130*e*. The ink stored in the ink storage chamber 130*e* can be discharged out from the ink syringe 130, by pushing the piston 130*b*, namely, by moving the piston 130*b* in the opposite direction that reduces the volume of the ink storage chamber 130*e*. A gas (e.g., air) can be sucked into the variable volume chamber of the cylindrical vessel 140*a*, by drawing the piston 140*b*, namely, by placing the variable volume chamber from its compressed state to its expanded state.

As shown in FIG. 8, the ink syringe 130 is fastened to the internally threaded portion 123*e* of the first valve-lifter 123, while the air sucker 140 is fastened to the internally threaded portion 122*e* of the second valve-lifter 122. FIG. 8 illustrates a state in which the ink syringe 130 is filled at its ink storage chamber 130*e* with the ink while the variable volume chamber of the air sucker 140 is placed in its compressed state. In the illustrated state, meanwhile, the ink stored in the ink chamber 16 of the ink cartridge 1 has been used up, with the thin walls 31, 15 of the ink cartridge 1 being broken.

The ink cartridge 1 is mounted on the cartridge filler 120, by introducing the axially-elongated tubular portions 123*a*, 122*a* of the first and second valve-lifters 123, 122 into the pipe receiver holes 40 of the valve devices 28, 24, respectively, while bringing the contact surface 121*d* of the attachment body 121 into contact with the bottom surface of the ink cartridge 1.

With the ink cartridge 1 being mounted on the cartridge filler 120, the axially-elongated tubular portion 122*a* of the second valve-lifter 122 is held in dose contact with the tapered inner surface of the pipe receiver hole 40 of the air-introduction-side valve device 24, while the upper end of the tubular portion 122*a* is held in contact with the second valve member 32, thereby lifting the second valve member 32 toward the ink chamber 16. Thus, as in the state illustrated in the view (b) of FIG. 4, the valve member 32 is moved against the elasticity of the biasing portion 46*b* in a direction opposite to the above-described biased direction, so as to be separated from the valve seat portion 46*a*, so that the second valve member 32 is placed in its open position. In this instance in which the second valve member 32 is moved away from its closed position by the second valve-lifter 122, a second communication passage is established in the above-described air introducing portion, such that the ink chamber 16 is brought into communication with the air sucker 140 through the second communication passage. In this sense, the second valve-lifter 122 may be considered to include a second communication-passage establisher operable to establish the second communication passage, which is constituted by the guide passage defined in the air guiding tubular wall 25, communication hole 26, air introducing chamber 50, communication holes 38, space defined between the mutually opposed surfaces of the second valve member 32 and the valve seat portion 46*a*, cutouts 122*b* and axial through-hole of the second valve-lifter 122.

Meanwhile, the axially-elongated tubular portion 123*a* of the first valve-lifter 123 is held in close contact with the tapered inner surface of the pipe receiver hole 40 of the ink-supply-side valve device 23, while the upper end of the tubular portion 123*a* is held in contact with the first valve member 32, thereby lifting the first valve member 32 toward the ink chamber 16. Thus, the valve member 32 is moved against the elasticity of the biasing portion 46*b* in a direction opposite to the above-described biased direction, so as to be separated from the valve seat portion 46*a*, so that the first valve member 32 is placed in its open position. In this instance in which the first valve member 32 is moved away from its closed position by the first valve-lifter 123, a first communication passage is established in the above-described ink supplying portion, such that the ink chamber 16 is brought into communication with the ink syringe 130 through the first communication passage. In this sense, the first valve-lifter 123 may be considered to include a first communication-passage establisher operable to establish the first communication passage, which is constituted by the above-described communication hole 21, ink supplying chamber 30, communication holes 38, space defined between the mutually opposed surfaces of the first valve member 32 and the valve seat portion 46*a*, cutouts 123*b* and axial through-hole of the first valve-lifter 123.

As is clear from the above description, a valve-member moving step is implemented by mounting the ink cartridge 1 onto the cartridge filler 120, namely, by positioning the ink cartridge 1 in a predetermined position relative to the cartridge filler 120. After the valve-member moving step has been implemented, a cartridge-posture adjusting step is implemented by adjusting a posture of the ink cartridge 1 such that an upper end of the communication hole 21 is positioned on a lower side of an upper end of the guide passage defined in the air guiding tubular wall 25.

The cartridge-posture adjusting step is followed by an ink supplying step in which the pressure in the ink chamber 16 of the ink cartridge 1 is reduced by manually moving the piston 140*b* of the air sucker 140 in a direction that increases the volume of the variable volume chamber of the vessel 140*a*, while at the same time the ink storage chamber 130*e* of the vessel 130*a* is compressed by manually moving the piston 130*b* of the ink syringe 130 in a direction that reduces the volume of the ink storage chamber 130*e*, so that the ink is supplied to the ink chamber 16 of the ink cartridge 1. In this instance, the ink can be supplied to the ink chamber 16, only by moving the piston 140*b* of the air sucker 140 in the above-described direction, without moving the piston 130*b* of the ink syringe 130. However, the ink cartridge 1 can be filled with the ink more rapidly where the ink storage chamber 130*e* is compressed by moving the piston 130*b* concurrently with the reduction of the pressure in the ink chamber 16 of the ink cartridge 1.

The casing body 1*a* of the ink cartridge 1 is made of a transparent or semi-transparent synthetic resin, so that an amount of the ink having supplied to the ink chamber 16 of the cartridge 1 can be visually confirmed. Therefore, when a desired amount of the ink has been supplied to the ink cartridge 1, the supply of the ink to the cartridge 1 can be stopped.

It is noted that the provision of the air sucker 140 is not essential. That is, the ink chamber 16 of the cartridge 1 may be held in communication with an atmosphere through the axial through-hole of the second valve-lifter 122. In this modified arrangement in which the air sucker 140 is not attached to the second valve-lifter 122, the ink supplying step is implemented by compressing the ink storage chamber 130*e* with the movement of the piston 130*b* of the ink syringe 130 in the above-described direction (that reduces the volume of the ink storage chamber 130*e*), so that the ink is supplied to the ink chamber 16 of the cartridge 1 while the air is discharged from the ink chamber 16 of the cartridge 1 through the communication hole 26, air-introduction-side valve device 24 and axial through-hole of the second valve-lifter 122. Where this modified arrangement is employed, the axially-elongated tubular portion 122*a* of the second valve-lifter 122 (which is introduced in the air-introduction-side valve device 24) may be replaced with a bar-like shaped portion which does not have an axial hole and which is configured to cooperate with the tapered inner surface of the pipe receiver hole 40 to define a spacing gap therebetween such that the air can be discharged through the spacing gap.

Where the ink supplying step is implemented with use of the air sucker 140, the ink may be supplied to the ink cartridge 1 from the ink storage chamber 130*e* of the vessel 130*a*, via a flexible tube connecting the vessel 130*a* to the internally threaded portion 123*e* of the first valve-lifter 123. In this case, the provision of the piston 130*b* in the vessel 130*a* is not necessary.

In the present process of filling the ink cartridge 1, the ink is supplied to the ink chamber 16 of the ink cartridge 1 through the ink-supply-side valve device 23, while the air is discharged from the ink chamber 16 through the air-introduction-side valve device 24. However, the supply of the ink and the discharge of the air can be made through the air-introduction-side valve device 24 and the ink-supply-side valve device 23, respectively.

Figure 10A:
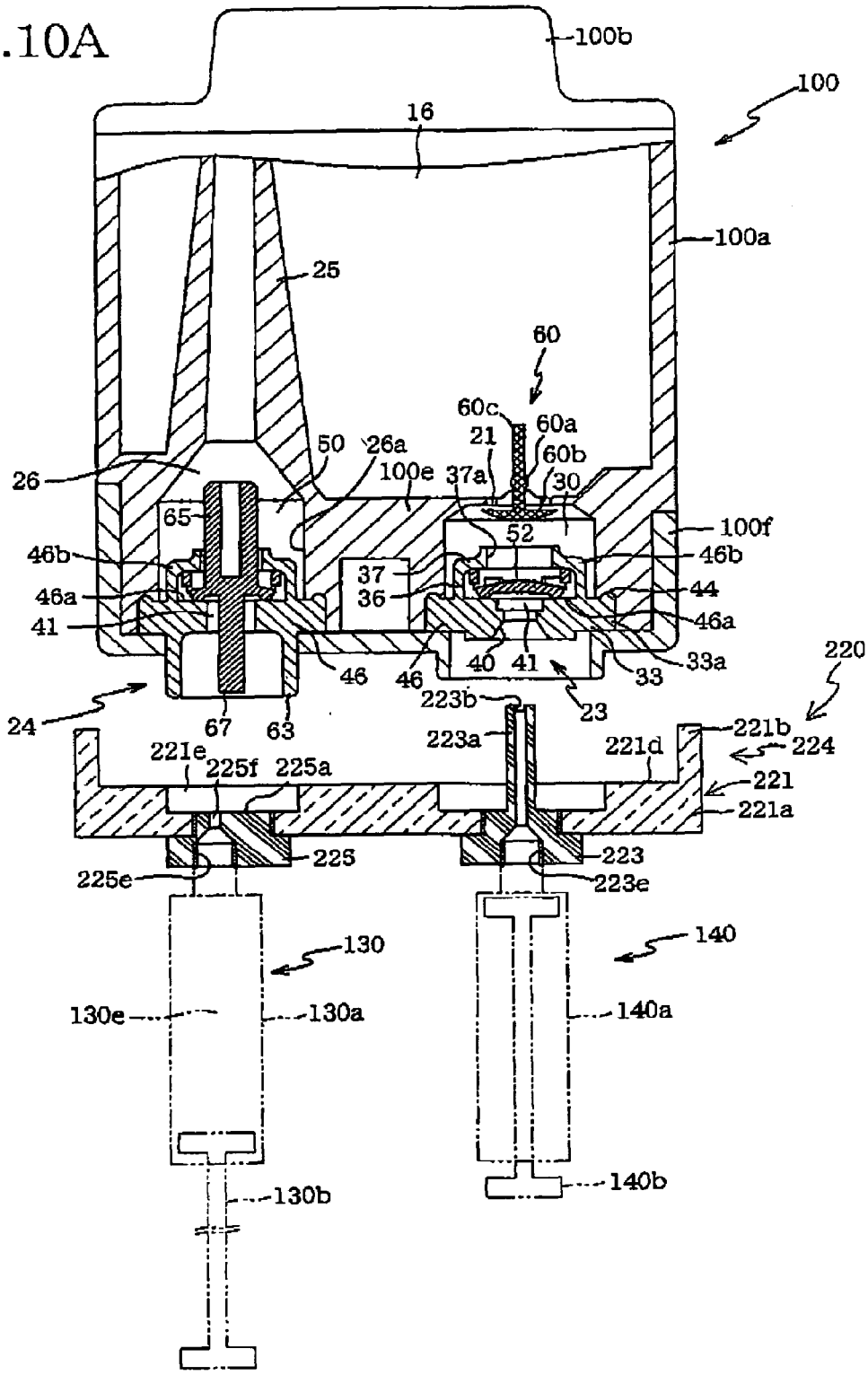
FIG. 10A is a view showing the second-type ink cartridge of the FIG. 5 and a cartridge filler for filling the second-type ink cartridge.
Figure 10B:
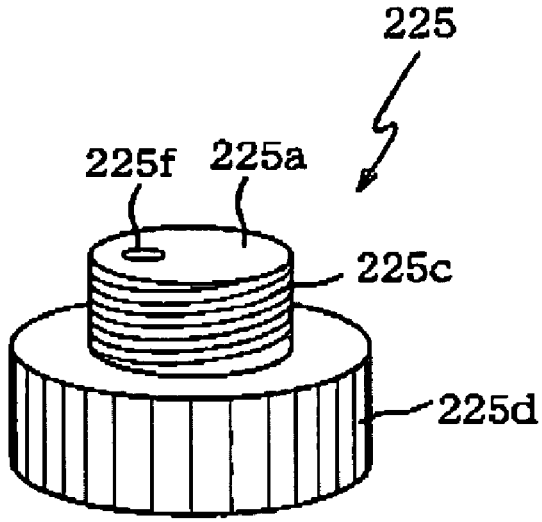
FIG. 10B is a perspective view showing a valve lifter that is to be attached to an attachment body of a jig which constitutes the cartridge filler of FIG. 10A.

Referring next to FIGS. 10A and 10B, there will be described a method of filling the above-described second-type ink cartridge 100 and also an ink filler 220 which is used for filling the second-type ink cartridge 100.

In the present method of filling the second-type ink cartridge 100, since the valve member 60 serving as a check valve is disposed between the ink chamber 16 and the ink supplying chamber 30, the ink is supplied to the ink chamber 16 of the ink cartridge 100 through the air-introduction-side valve device 24 while the air is discharged from the ink chamber 16 through the ink-supply-side valve device 23. A jig 224 of the ink filler 220 includes first and second valve-lifters 225, 223 for lifting respective second and first valve members 65, 52, and an attachment body 221 which holds the first and second valve-lifters 225, 223 so as to connect the valve lifters 225, 223 and the ink cartridge 100. The first valve-lifter 225 cooperates with the ink syringe 130 to constitute an ink supplier, while the second valve-lifter 223 cooperates with the air sucker 140 to constitute an air discharger. The attachment body 221 is substantially identical in shape with the above-described attachment body 121 of the jig 124, and has a plate-like base portion 221*a* as a contact surface definer defining a contact surface 221*d* which is to be held in contact with a lower surface of the lower cap member 100*f* of the cartridge 100, and opposite side wall portions 221*b* which extend from respective opposite ends of the base portion 221*a* and which is to be held in contact with respective side surfaces of the cap member 100*f* of the cartridge 100.

Since the second valve member 65 of the air-introduction-side valve device 24 has the axial extension 67 extending outwardly from the air introducing chamber 50, the generally cylindrical-shaped first valve-lifter 225 of the jig 224 does not have an axially-elongated tubular portion as the above-described tubular portion 122*a* or 123*a*. As shown in FIG. 10B, the valve lifter 225 includes an externally-threaded portion 225*c*, a knob portion 225*d* and an end surface 225*a* as a contact portion which is provided by one of axially opposite end surfaces that is closer to the externally-threaded portion 225*c* rather than to the knob portion 225*d* and which is to be brought into contact with the axial extension 67 of the second valve member 65. The valve lifter 225 has an axial through-hole 225*f* formed therethrough. This axial through-hole 225*f* is radially offset from an axis of the valve lifter 225 by a predetermined radial distance, rather than being aligned with the axis of the valve lifter 225, so that an opening end of the axial through-hole 225*f* is not closed by a lower end face of the axial extension 67 of the second valve member 65 when the valve lifter 225 is brought into contact at its end surface 225*a* with the axial extension 67 of the valve member 65. The axial through-hole of the valve lifter 225 has a large diameter portion located in its lower end portion, i.e., in one of its axially opposite end portions that is remote from the end surface 225*a*. The first valve-lifter 225 has an ink-storage fastener in the form of an internally threaded portion 225*e* which is provided in the large diameter portion of the axial through-hole 225*f*, so that the ink syringe 130 as the ink storage is fastenable to the first valve-lifter 225.

A recess 221*e* is formed in the contact surface 221*d* of the attachment body 221. This recess 221*e* is positioned to be aligned with the air-introduction-side valve device 24, and has a bottom end which is partially defined by the end surface 225*a* of the first valve-lifter 225. As the above-described recess 3*d* of the mount portion 3 of the inkjet printer 2, the recess 221*e* has a diameter that permits the recess 221*e* to be fitted onto the sealing portion 63 of the holding member 46 when the ink cartridge 100 is mounted on the cartridge filler 220. When the sealing portion 63 is fitted in the recess 221*e*, the distal end portion of the sealing portion 63 is deformed and held in close contact with the recess 221*e*, whereby the valve device 24 and the jig 224 are fluid-tightly connected to each other.

The end surface 225 of the first valve-lifter 225 is positioned relative to the contact surface 221*d* of the attachment body 221, such that the second valve member 65 is positioned, by the first valve-lifter 225, between the above-described first and second closed positions as viewed in the biased direction while the contact surface 221*d* is held in contact with the cap member 100*f* of the ink cartridge 100. In other words, the end surface 225 of the valve-lifter 225 and the contact surface 221*d* of the attachment body 221 have a positional relationship that allows the valve member 65 to be positioned to be separated from the valve seat portion 64*a* as well as from the tapered inner surface of the communication hole 26 while the contact surface 221*d* is held in contact with the casing body of the ink cartridge 100.

The second valve-lifter 223 of the jig 224 is identical in shape with each of the above-described first and second valve-lifters 123, 122 of the jig 124. As shown in FIG. 10A, the ink syringe 130 is fastened to the internally threaded portion 225*e* of the first valve-lifter 225, while the air sucker 140 is fastened to the internally threaded portion 223*e* of the second valve-lifter 223. FIG. 10A illustrates a state in which the ink syringe 130 is filled at its ink storage chamber 130*e* with the ink while the variable volume chamber of the air sucker 140 is placed in its compressed state. When the ink cartridge 100 is mounted on the cartridge filler 220 with the casing body of the cartridge 100 being held in contact with the contact surface 221*d* of the attachment body 221, the first valve member 52 is lifted upward by the second valve-litter 223 (which is held in contact at its tubular portion 223*a* with the lower surface of the first valve member 52) so as to be placed in its open position, while the second valve member 65 is lifted upwardly by the first valve-lifter 225 (which is held in contact at its end surface 225*a* with the axial extension 67 of the second valve member 65).

In this instance in which the second valve member 65 is moved away from its closed position by the first valve-lifter 225, a first communication passage is established in the above-described air introducing portion, such that the ink chamber 16 is brought into communication with the ink syringe 130 through the first communication passage. In this sense, the first valve-lifter 225 may be considered to include a first communication-passage establisher operable to establish the first communication passage, which is constituted by the above-described guide passage defined in the air guiding tubular wall 25, communication hole 26, air introducing chamber 50, communication apertures 58, space defined between the mutually opposed surfaces of the second valve member 65 and the valve seat portion 46*a*, and axial through-hole of the second valve-lifter 225. Meanwhile, a second communication passage is established in the above-described ink supplying portion, such that the ink chamber 16 is brought into communication with the air sucker 140 through the second communication passage. In this sense, the second valve-lifter 223 may be considered to include a second communication-passage establisher operable to establish the second communication passage, which is constituted by the above-described communication holes 21, ink supplying chamber 30, space defined between the mutually opposed surfaces of the first valve member 52 and the valve seat portion 46*a*, cutouts 223*b* and axial through-hole of the second valve-lifter 223.

After the valve-member moving step has been implemented as described above, the cartridge-posture adjusting step is implemented by adjusting a posture of the ink cartridge 100 such that the upper end of the guide passage defined in the air guiding tubular wall 25 is positioned on a lower side of the communication holes 21. That is, the ink cartridge 100 attached to the cartridge filler 220 is substantially inverted from a posture illustrated in FIG. 10A.

The cartridge-posture adjusting step is followed by the ink supplying step in which the valve member 60 is moved to its open position allowing flow of the air in a direction away from the ink chamber 16 toward the ink supplying chamber 30, as a result of movement of the piston 140*b* of the air sucker 140 in the direction that increases the volume of the variable volume chamber of the vessel 140*a*, so that the ink chamber 16 of the cartridge 100 can be filled with the ink supplied from the ink storage chamber 130*e* of the ink syringe 130, as in the above-described process of filling the ink cartridge 1.

The provision of the air sucker 140 is not essential, also in the present process of filling the ink cartridge 100. That is, the ink chamber 16 of the cartridge 100 may be held in communication with an atmosphere through the axial through-hole of the second valve-lifter 223. In this modified arrangement in which the air sucker 140 is not attached to the second valve-lifter 223, the ink supplying step is implemented by compressing the ink storage chamber 130*e* with the movement of the piston 130*b* of the ink syringe 130 in the above-described direction (that reduces the volume of the ink storage chamber 130*e*), so that the ink is supplied to the ink chamber 16 of the cartridge 100 while the air is discharged from the ink chamber 16 of the cartridge 1 through the communication holes 21, ink-supply-side valve device 23 and axial through-hole of the second valve-lifter 223. Where this modified arrangement is employed, the axially-elongated tubular portion 223*a* of the second valve-lifter 223 (which is introduced in the ink-supply-side valve device 23) may be replaced with a bar-like shaped portion which does not have an axial hole and which is configured to cooperate with the tapered inner surface of the pipe receiver hole 40 to define a spacing gap therebetween such that the air can be discharged through the spacing gap.

Where the ink supplying step is implemented with use of the air sucker 140, the ink may be supplied to the ink cartridge 100 from the ink storage chamber 130*e* of the vessel 130*a*, via a flexible tube connecting the vessel 130*a* to the internally threaded portion 225*e* of the first valve-lifter 225. In this case, the provision of the piston 130*b* in the vessel 130*a* is not necessary.

In the present process of filling the second-type ink cartridge 100, the ink is supplied to the ink chamber 16 of the cartridge 100 through the air-introduction-side valve device 24, while the air is discharged from the ink chamber 16 through the ink-supply-side valve device 23. However, the supply of the ink and the discharge of the air can be made through the ink-supply-side valve device 23 and the air-introduction-side valve device 24, respectively, as in the process of filling the first-type ink cartridge 1. In this modified arrangement, the ink is slowly supplied through the ink-supply-side valve device 23 at a low rate avoiding the valve member 60 as the check valve from being moved in the direction closing the communication holes 21.

As is clear from the foregoing description, in the cartridge filling process or method according to the present invention, each of the first and second valve members is moved in the direction away from the closed position, and then the ink is supplied to the inner space of the ink cartridge through one of the air introducing portion and the ink supplying portion while the air is discharged from the inner space of the ink cartridge through the other of the air introducing portion and the ink supplying portion. This arrangement enables the ink cartridge to be efficiently and rapidly filled or refilled with the ink, owing to a smooth discharge of the air out of the inner space of the ink cartridge through the above-described other of the air introducing portion and the ink supplying portion. Further, this arrangement can be carried out easier than the above-described conventional arrangement in which a through-hole is formed in a casing body of the ink cartridge, for example, by using a drill.

Further, by using the cartridge filler or jig constructed according to the invention, the ink cartridge can be appropriately and rapidly filled or refilled with the ink, with an easy operation.

Further, in the above-described embodiment, the ink syringe and the air sucker are detachably fastened to the valve lifters, and the valve lifters are detachably fastened to the attachment body. Therefore, the cartridge filler can be stored in a small space, by detaching the ink syringe and the air sucker from the valve lifters and/or detaching the valve lifters from the attachment body. Further, where the cartridge filler is used for filling a plurality of ink cartridges with respective different color inks, the cartridge filler can be used commonly for the different color inks, by replacing only the first valve lifter and the ink syringe with other ones.

While the presently preferred embodiment of the invention has been described above in detail, it is to be understood that the invention is not limited to the details of the illustrated embodiment, but may be embodied with various other changes, modifications and improvements.

For example, the ink supplying step is implemented by positioning the cartridge filler 120 on a lower side of the ink cartridge 1 in the process of filling the cartridge 1, while the ink supplying step is implemented by positioning the cartridge filler 220 on an upper side of the inverted ink cartridge 100 in the process of filling the cartridge 100. However, the ink supplying step may be implemented with any other positional relationship between the ink cartridge and the cartridge filler, as long as the supplied ink can be located on a lower side of the gas (that is to be discharged from the ink chamber 16 of the cartridge) in the ink chamber 16.

Further, in the above-describe embodiment, the ink supplier and the air discharger are fixed relative to each other through the attachment body. However, the ink supplier and the air discharger do not have to be fixed relative to each other Further, in the above-described embodiment, the ink syringe, the air sucker and the valve lifters are detachably fastened to the attachment body, so as to be replaceable with other ones, depending upon the color of ink and/or the type of ink cartridge. However, these components of the cartridge filler may be formed integrally with each other or provided by a single piece, so that the cartridge filler is used exclusively for a certain color of ink or a certain type of ink cartridge.

Further, each of the ink syringe and the air sucker does not necessarily have to be provided by the syringe including the vessel and the piston fitted in the vessel but may be provided by a known pump or other fluid delivering device.

What is claimed is:

1. A method of filling an ink cartridge which has (i) an ink supplying portion provided to face an inner space of the ink cartridge so as to allow supply of an ink from the inner space therethrough, (ii) an air introducing portion provided to face the inner space so as to allow introduction of an air into the inner space therethrough, (iii) a first valve member which is disposed in the ink supplying portion and which is biased in a biased direction that causes the first valve member to be placed in a closed position thereof inhibiting the supply of the ink from the inner space through the ink supplying portion, and (iv) a second valve member which is disposed in the air introducing portion and which is biased in a biased direction that causes the second valve member to be placed in a closed position thereof inhibiting the introduction of the air into the inner space through the air introducing portion, wherein each of the first and second valve members is moved, upon installation of the ink cartridge on a recording apparatus, in an opposite direction opposite to the biased direction, said method comprising:

(a) a valve-member moving step of moving each of the first and second valve members in the opposite direction away from the closed position thereof; and (b) an ink supplying step of supplying the ink to the inner space of the ink cartridge through one of the air introducing portion and the ink supplying portion while discharging the air from the inner space of the ink cartridge through the other of the air introducing portion and the ink supplying portion, wherein said valve-member moving step implemented by using a jig includes a first valve-lifter and a second valve-lifter, such that said valve-member moving step includes (a-1) a first-valve-lifter operation step of bringing the first valve-lifter into contact with one of the first and second valve members and causing the first valve-lifter to move said one of the first and second valve members in said opposite direction any from the closed position thereof, and (a-2) a second-valve-lifter operation step of bringing the second valve-lifter into contact with the other of the first and second valve members and causing the second valve-lifter to move said other of the first and second valve members in said opposite direction away from the closed position thereof, wherein said ink supplying step is implemented while each of the first and second valve members is kept, by a corresponding one of the first and second valve-lifters, distant from the closed position thereof, wherein the used jig has a contact surface that is to be held in contact with a surface of a casing body or the cartridge, such that said valve-member moving step further includes a lift amount defining step of defining an amount of lift of each of the first and second valve members moved by a corresponding one of the first and second valve-lifters, by bringing the contact surface of the jig into contact with the surface of the casing body of the ink cartridge, wherein the second valve member of the ink cartridge has a second closed position, in addition to the closed position as a first closed position, which is located on a rear side of the first closed position as viewed in the biased direction, and wherein the second valve member is positioned, by a corresponding one of the first and second valve-lifters of the jig, between the first and second closed positions thereof as viewed in the biased direction in said lift amount defining step of said valve-member moving step in which the contact surface of the jig is brought into contact with the surface of the casing body of the ink cartridge.

2. A cartridge filler for filling an ink cartridge which has (i) an ink supplying portion provided to face an inner space of the ink cartridge so as to allow supply of an ink from the inner space therethrough, (ii) an air introducing portion provided to face the inner space so as to allow introduction of an air into the inner space therethrough, (iii) a first valve member which is disposed in the ink supplying portion and which is biased in a biased direction that causes the first valve member to be placed in a closed position thereof inhibiting the supply of the ink from the inner space through the ink supplying portion, and (iv) a second valve member which is disposed in the air introducing portion and which is biased in a biased direction that causes the second valve member to be placed in a closed position thereof inhibiting the introduction of the air into the inner space through the air introducing portion, wherein each of the first and second valve members is moved, upon installation of the ink cartridge on a recording apparatus, in an opposite direction opposite to the biased direction, said cartridge filler comprising:

an ink supplier operable to move one of the first and second valve members in the opposite direction away from the closed position thereof, and to supply the ink to the inner space of the ink cartridge, through one of the air introducing portion and the ink supplying portion in which said one of the first and second valve members is disposed; and an air discharger operable to move the other of the first and second valve members in the opposite direction away from the closed position thereof, end to discharge the air from the inner space of the ink cartridge, through the other of the air introducing portion and the ink supplying portion in which said other of the first and second valve members is disposed, wherein said ink supplier includes a first valve-lifter which is brought into contact with said one of the first and second valve members so as to move said one of the first and second valve members in the opposite direction away from the closed position thereof, and wherein said air discharger includes a second valve-lifter which is brought into contact with said other of the first and second valve members so as to move said other of the first and second valve members toward in the opposite direction away from the closed position thereof, said cartridge filler further comprising an attachment body which holds said first and second valve-lifters, so as to connect said first and second valve-lifters and the ink cartridge, wherein at least said first valve-lifter is detachably held by said attachment body.

3. The cartridge filler according to claim 2, wherein said air discharger brings the inner space of the ink cartridge into communication with an atmosphere through said other of the air introducing portion and the ink supplying portion, by moving said other of the first and second valve members in said opposite direction, and allows a flow of the air out of the inner space through said other of the air introducing portion and the ink supplying portion, while the ink is being supplied to the inner space through said one of the air introducing portion and the ink supplying portion by said ink supplier.

4. The cartridge filler according to claim 3, wherein said ink supplier includes an ink storage storing the ink that is to be supplied to the inner space of the ink cartridge through said one of the air introducing portion and the ink supplying portion, wherein said first valve-lifter includes a first communication-passage establisher operable, when said one of the first and second valve members is moved away from the closed position thereof by said first valve-lifter, to establish a first communication passage in said one of the air introducing portion and the ink supplying portion in which said one of the first and second valve members is disposed, such that the inner space of the ink cartridge is brought into communication with said ink storage of said ink supplier through said first communication passage, and wherein said second valve-lifter includes a second communication-passage establisher operable, when said other of the first and second valve members is moved away from the closed position thereof by said second valve-lifter, to establish a second communication passage in said other of the air introducing portion and the ink supplying portion in which said other of the first and second valve members is disposed, such that the inner space of the ink cartridge is brought into communication with an atmosphere through said second communication passage.

5. The cartridge filler according to claim 4, wherein said ink storage is detachably fastened to said first communication-passage establisher.

6. The cartridge filler according to claim 2, wherein said air discharger includes an air sucker operable to suck the air in the inner space of the ink cartridge through said other of the air introducing portion and the ink supplying portion.

7. The cartridge filler according to claim 6, wherein said ink supplier includes an ink storage storing the ink that is to be supplied to the inner space of the ink cartridge through said one of the air introducing portion and the ink supplying portion, wherein said first valve-lifter includes a first communication-passage establisher operable, when said one of the first and second valve members is moved away from the closed position thereof by said first valve-lifter, to establish a first communication passage in said one of the air introducing portion and the ink supplying portion in which said one of the first and second valve members is disposed, such that the inner space of the ink cartridge is brought into communication with said ink storage of said ink supplier through said first communication passage, and wherein said second valve-lifter includes a second communication-passage establisher operable, when said other of the first and second valve members is moved away from the closed position thereof by said second valve-lifter, to establish a second communication passage in said other of the air introducing portion and the ink supplying portion in which said other of the first and second valve members is disposed, such that the inner space of the ink cartridge is brought into communication with said air sucker through said second communication passage.

8. The cartridge filler according to claim 7, wherein said ink storage and said air sucker are detachably fastened to said first communication-passage establisher and said second communication-passage establisher, respectively.

9. The cartridge filler according to claim 2, further comprising a contact surface definer defining a contact surface which is brought into contact with a surface of a casing body of the ink cartridge, wherein said contact surface is positioned relative to each of said first and second valve-lifters, such that each of said first and second valve members is kept by a corresponding one of said first and second valve-lifters, distant from the closed position thereof while said contact surface is held in contact with the surface of the casing body of the ink cartridge.

10. The cartridge filler according to claim 2, used for filling the ink cartridge which further has (v) a check valve inhibiting a flow of the ink into the inner space through the ink supplying portion, wherein said ink supplier moves the second valve member which is disposed in the air introducing portion, away from the closed position thereof, and supplies the ink to the inner space of the ink cartridge, through the air introducing portion in which the second valve member is disposed, and wherein said air discharger moves the first valve member which is disposed in the ink supplying portion, away from the closed position thereof, and discharges the air from the inner space of the ink cartridge, through the ink supplying portion in which the first valve member is disposed.

11. The cartridge filler according to claim 2, used for filling the ink cartridge wherein each of the first and second valve members is held in an elastically-deformable holding member which includes a valve seat portion arid a biasing portion such that each of the first and second valve members is biased by the biasing portion in the biased direction that causes the each of the first and second valve members to be seated on the valve seat portion so as to be placed in the closed position thereof, wherein each of said first and second valve-lifters moves a corresponding one of the first and second valve members away from the valve seat portion of the elastically-deformable holding member.

12. A cartridge filler for filling an ink cartridge which has (i) an ink supplying portion provided to face an inner space of the ink cartridge so as to allow supply of an ink from the inner space therethrough, (ii) an air introducing portion provided to face the inner space so as to allow introduction of an air into the inner space therethrough, (iii) a first valve member which is disposed in the ink supplying portion and which is biased in a biased direction that causes the first valve member to be placed in a closed position thereof inhibiting the supply of the ink from the inner space through the ink supplying portion, and (iv) a second valve member which is disposed in the ink supplying portion and which is biased in a biased direction that causes the second valve member to be placed in a closed position thereof inhibiting the introduction of the air into the inner space through the air introducing portion, wherein each of the first and second valve members is moved, upon installation of the ink cartridge on a recording apparatus, in an opposite direction opposite to the biased direction, said cartridge filler comprising:

an ink supplier operable to move one of the first and second valve members in the opposite direction away from the closed position thereof, and to supply the ink to the inner space of the ink cartridge, through one of the air introducing portion and the ink supplying portion in which said one of the first and second valve members is disposed; and an air discharger operable to move the other of the first and second valve members in the opposite direction away from the closed position thereof, and to discharge the air from the inner space of the ink cartridge, through the other of the air introducing portion and the ink supplying portion in which said other of the first and second valve members is disposed, wherein said ink supplier includes a first valve-lifter which is brought into contact with said one of the first and second valve members so as to move said one of the first and second valve members in the opposite direction away from the closed position thereof, and wherein said air discharger includes a second valve-lifter which is brought into contact with said other of the first and second valve members so as to move said other of the first and second valve members toward in the opposite direction away from the closed position thereof, said cartridge filler further comprising a contact surface definer defining a contact surface which is brought into contact with a surface of a casing body of the ink cartridge, wherein said contact surface is positioned relative to each of said first and second valve-lifters, such that each of said first and second valve members is kept by a corresponding one of said first and second valve-lifters, distant from the closed position thereof while said contact surface is held in contact with the surface of the casing body of the ink cartridge, said cartridge filler being used for filling the ink cartridge wherein the second valve member has a second closed position, in addition to the closed position as a first closed position, which is located on a rear side of the first closed position as viewed in the biased direction, wherein said contact surface is positioned relative to one of said first and second valve-lifters which moves the second valve member in the opposite direction away from the first closed position thereof, such that the second valve member is positioned, by said one of said first and second valve-lifters, between the first and second closed positions thereof as viewed in the biased direction while said contact surface is held in contact with the surface of the casing body of the ink cartridge.

13. A jig used for filling an ink cartridge which has (i) an ink supplying portion provided to face an inner space of the ink cartridge so as to allow supply of an ink from the inner space therethrough, (ii) an air introducing portion provided to face the inner space so as to allow introduction of an air into the inner space therethrough, (iii) a first valve member which is disposed in the ink supplying portion and which is biased in a biased direction that causes the first valve member to be placed in a closed position thereof inhibiting the supply of the ink from the inner space through the ink supplying portion, and (iv) a second valve member which is disposed in the air introducing portion and which is biased in a biased direction that causes the second valve member to be placed in a closed position thereof inhibiting the introduction of the air into the inner space through the air introducing portion, wherein each of the first and second valve members is moved, upon installation of the ink cartridge on a recording apparatus, in an opposite direction opposite to the biased direction, said jig comprising:

a first valve-lifter operable to move one of the first and second valve members in the opposite direction away from the closed position thereof; and a second valve-lifter operable to move the other of the first and second valve members in the opposite direction away from the closed position thereof, wherein said first valve-lifter includes a first communication-passage establisher operable, when said one of the first and second valve members is moved away from the closed position thereof by said first valve-lifter, to establish a first communication passage in one of the air introducing portion and the ink supplying portion in which said one of the first and second valve members is disposed, such that said first communication passage allows supply of the ink to the inner space of the ink cartridge through said one of the air introducing portion and the ink supplying portion, and wherein said second valve-lifter includes a second communication-passage establisher operable, when said other of the first and second valve members is moved away from the closed position thereof by said second valve-lifter, to establish a second communication passage in the other of the air introducing portion and the ink supplying portion in which said other of the first and second valve members is disposed, such that said second communication passage allows discharge of the air from the inner space of the ink cartridge through said other of the air introducing portion and the ink supplying portion, said jig further comprising an attachment body which holds said first and second valve-lifters, so as to connect said first and second valve-lifters and the ink cartridge, wherein at least said first valve-lifter is detachably held by said attachment body.

14. The jig according to claim 13, further comprising an ink-storage fastener to which is fastenable an ink storage storing the ink that is to be supplied to the inner space of the ink cartridge through said first communication passage, wherein said ink-storage fastener is provided in said first communication-passage establisher.

15. The jig according to claim 13, further comprising an air-sucker fastener to which fastenable an air sucker that is operable to suck the air in the inner space of the ink cartridge through said second communication passage, wherein said air sucker fastener is provided in said second communication-passage establisher.

16. The jig according to claim 13, further comprising a contact surface definer defining a contact surface which is brought into contact with a surface of a casing body of the ink cartridge, wherein said contact surface is positioned relative to each of said first and second valve-lifters, such that each of said first and second valve members is kept by a corresponding one of said first and second valve-lifters, distant from the closed position thereof while said contact surface is held in contact with the surface of the casing body of the ink cartridge.

17. The jig according to claim 13, used for filling the ink cartridge which further has (v) a check valve inhibiting a flow of the ink into the inner space through the ink supplying portion, wherein said first valve-lifter moves the second valve member which is disposed in the air introducing portion, away from the closed position thereof, so that said first communication passage is established in the air introducing portion by said first communication-passage establisher, and wherein said second valve-lifter moves the first valve member which is disposed in the ink supplying portion, away from the closed position thereof, so that said second communication passage is established in the ink supplying portion by said second communication-passage establisher.

18. The jig according to claim 13, used for filling the ink cartridge wherein each of the first and second valve members is held in an elastically-deformable holding member which includes a valve seat portion and a biasing portion such that each of the first and second valve members is biased by the biasing portion in the biased direction that causes the each of the first and second valve members to be seated on the valve seat portion so as to be placed in the closed position thereof, wherein each of said first and second valve-lifters moves a corresponding one of the first and second valve members away from the valve seat portion of the elastically-deformable holding member.

19. A jig used for filling an ink cartridge which has (i) an ink supplying portion provided to face an inner space of the ink cartridge so as to allow supply of an ink from the inner space therethrough, (ii) an air introducing portion provided to face the inner space so as to allow introduction of an air into the inner space therethrough, (iii) a first valve member which is disposed in the ink supplying and which is biased in a biased direction that causes the first valve member to be placed in a closed position thereof inhibiting the supply of the ink from the inner space though the ink supplying portion, and (iv) a second valve member which is disposed in the air introducing portion and which is biased in a biased direction that causes the second valve member to be placed in a closed position thereof inhibiting the introduction of the air into the inner space through the air introducing portion, wherein each of the first and second valve members is moved, upon installation of the ink cartridge on a recording apparatus, in an opposite direction opposite to the biased direction, said jig comprising:

a first valve-lifter operable to move one of the first and second valve members in the opposite direction away from the closed position thereof; and a second valve-lifter operable to move the other of the first and second valve members in the opposite direction away from the position thereof, wherein said first valve-lifter includes a first communication-passage establisher operable, when said one of the first and second valve members is moved away the closed position thereof by said first valve-lifter, to establish a first communication passage in one of the air introducing portion and the ink supplying portion in which said one of the first and second valve members is disposed, such that said first communication passage allows supply of the ink to the inner space of the ink cartridge through said one of the air introducing portion and the ink supplying portion, and wherein said second valve-lifter includes a second communication-passage establisher operable, when said other of the first and second valve members is moved away from the closed position thereof by said second valve-lifter, to establish a second communication passage in the other of the air introducing portion and the ink supplying portion in which said other of the first and second valve members is disposed, such that said second communication passage allows discharge of the air from the inner space of the ink cartridge through said other of the air introducing portion and the ink supplying portion, said jig further comprising a contact surface definer defining a contact surface which is brought into contact with a surface of a casing body of the ink cartridge, wherein said contact surface is positioned relative to each of said first and second valve-lifters, such that each of first and second valve members is kept by a corresponding one of said first and second valve-lifters, distant from the closed position thereof while said contact surface is held in contact with the surface of the casing body of the ink cartridge said jig being used for filling the ink cartridge wherein the second valve member has a second closed position, in addition to the closed position as a first closed position, which is located on a rear side of the first closed position as viewed in the biased direction, wherein said contact surface is positioned relative to one of said first and second valve-lifters which moves the second valve member in the opposite direction away from the first closed position thereof, such that the second valve member is positioned, by said one of said first and second valve-lifters, between the first and second closed positions thereof as viewed in the biased direction while said contact surface is held in contact with the surface of the casing body of the ink cartridge.

20. An ink supply system for supplying an ink to a recording apparatus, said system comprising:

an ink cartridge which has (i) an ink supplying portion provided to face an inner space of said ink cartridge so as to allow supply of an ink from said inner space therethrough, (ii) an air introducing portion provided to face said inner space so as to allow introduction of an air into said inner space therethrough, (iii) a first valve member which is disposed in said ink supplying portion and which is biased in a biased direction that causes said first valve member to be placed in a closed position thereof inhibiting the supply of the ink from said inner space through said ink supplying portion, and (iv) a second valve member which is disposed in said air introducing portion and which is biased in a biased direction that causes said second valve member to be placed in a closed position thereof inhibiting the introduction of the air into said inner space through said air introducing portion, wherein each of said first and second valve members is moved, upon installation of said ink cartridge on the recording apparatus, in an opposite direction opposite to the biased direction; and the cartridge filler defined in claim 2.

21. A method of filling, by using the cartridge filler, an ink cartridge which has (i) an ink supplying portion provided to face an inner space of the ink cartridge so as to allow supply of an ink from the inner space therethrough, (ii) an air introducing portion provided to face the inner space so as to allow introduction of an air into the inner space therethrough, (iii) a first valve member which is disposed in the ink supplying portion and which is biased in a biased direction that causes the first valve member to be placed in a closed position thereof inhibiting the supply of the ink from the inner space through the ink supplying portion, and (iv) a second valve member which is disposed in the air introducing portion and which is biased in a biased direction that causes the second valve member to be placed in a closed position thereof inhibiting the introduction of the air into the inner space through the air introducing portion, wherein each of the first and second valve members is moved, upon installation of the ink cartridge on a recording apparatus, in an opposite direction opposite to the biased direction, said cartridge filler including an ink supplier operable to move one of the first and second valve members in the opposite direction away from the closed position thereof, and to supply the ink to the inner space of the ink cartridge, through one of the air introducing portion and the ink supplying portion in which said one of the first and second valve members is disposed, and an air discharger operable to move the other of the first and second valve members in the opposite direction away from the closed position thereof, and to discharge the air from the inner space of the ink cartridge, through the other of the air introducing portion and the ink supplying portion in which said other of the first and second valve members is disposed, wherein said ink supplier includes a first valve-lifter which is brought into contact with said one of the first and second valve members so as to move said one of the first and second valve members in the opposite direction away from the closed position thereof, and wherein said air discharger includes a second valve-lifter which is brought into contact with said other of the first and second valve members so as to move said other of the first and second valve members toward in the opposite direction away from the closed position thereof, said cartridge filler further including an attachment body which holds said first and second valve-lifters, so as to connect said first and second valve-lifters and the ink cartridge, wherein at least said first valve-lifter is detachably held by said attachment body, said method comprising:

causing said ink supplier to move one of the first and second valve members via said first valve-lifter in the opposite direction away from the closed position thereof, while causing said air discharger to move the other of the first and second valve members via said second valve-lifter in the opposite direction away from the closed position thereof the first and second valve-lifters being held by said attachment body; and causing said ink supplier to supply the ink to the inner space of the ink cartridge through one of the air introducing portion and the ink supplying portion, while causing said air discharger to discharge the air from the inner space of the ink cartridge through the other of the air introducing portion and the ink supplying portion.

22. A cartridge filler for filling ink cartridge which has (i) an ink supplying portion provided to face an inner space of the ink cartridge so as to allow supply of an ink from the inner space therethrough, (ii) an air introducing portion provided to face the inner space so as to allow introduction of an air into the inner space therethrough, (iii) a first valve member which is disposed in the ink supplying portion and which is biased in a biased direction that causes the first valve member to be placed in a closed position thereof inhibiting the supply of the ink from the inner space through the ink supplying portion, and (iv) a second valve member which is disposed in the air introducing portion and which is biased in a biased direction that causes the second valve member to be placed in a closed position thereof inhibiting the introduction of the air into the inner space through the air introducing portion, wherein each of the first and second valve members is moved, upon installation of the ink cartridge on a recording apparatus, in an opposite direction opposite to the biased direction, said cartridge filler comprising:

an ink supplier operable to move one of the first and second valve members in the opposite direction away from the closed position thereof, and to supply the ink to the inner space of the ink cartridge, through one of the air introducing portion and the ink supplying portion in which said one of the first and second valve members is disposed;

an air discharger operable to move the other of the first and second valve members in the opposite direction away from the closed position thereof, and to discharge the air from the inner space of the ink cartridge, though the other of the air introducing portion and the ink supplying portion in which said other of the first and second valve members is disposed; and the jig defined in claim 13, wherein said first valve-lifter is included in said ink supplier, while said second valve-lifter is included in said air discharger.

* * * * *

UNITED STATES PATENT AND TRADEMARK OFFICE

CERTIFICATE OF CORRECTION

PATENT NO. : 7,393,088 B2
APPLICATION NO. : 11/150293
DATED : July 1, 2008
INVENTOR(S) : Toyonori Sasaki It is certified that error appears in the above-identified patent and that said Letters Patent is hereby corrected as shown below:

Column 22, Claim 1, Lines 14-15:
Please replace "casing body or the cartridge" with --casing body of the ink cartridge--.

Column 25, Claim 12, Lines 11-12:
Please replace "disposed in the ink supplying portion" with --disposed in the air introducing portion--.

Column 27, Claim 19, Line 64:
Please replace "away from the position thereof" with --away from the closed position thereof--.

Column 27, Claim 19, Line 67:
Please replace "valve members is moved away the" with --valve members is moved away from the--.

Signed and Sealed this

Fourteenth Day of July, 2009

John Doll

JOHN DOLL
*Acting Director of the United States Patent and Trademark Office*